US005614922A

United States Patent [19]

Kawaguchi et al.

[11] Patent Number: 5,614,922

[45] Date of Patent: Mar. 25, 1997

[54] DISPLAY APPARATUS

[75] Inventors: Takafumi Kawaguchi, Yamatotakada; Akira Tomiyoshi; Makoto Takeda, both of Nara, all of Japan

[73] Assignee: Sharp Kabushiki Kaisha, Osaka, Japan

[21] Appl. No.: 414,717

[22] Filed: Mar. 31, 1995

[30] Foreign Application Priority Data

Apr. 4, 1994 [JP] Japan ..... 6-066145

[51] Int. Cl.[6] ..... G09G 3/36

[52] U.S. Cl. ..... 345/89; 345/94; 345/100

[58] Field of Search ..... 345/87, 89, 94, 345/99, 100, 150, 208, 211; 359/55, 56

[56] References Cited

U.S. PATENT DOCUMENTS 5,119,086 6/1992 Nishioka et al. ..... 345/150

FOREIGN PATENT DOCUMENTS

0433054A2 6/1991 European Pat. Off. .
0515191A2 11/1992 European Pat. Off. .
513551 11/1992 European Pat. Off. ..... 345/89

OTHER PUBLICATIONS

Okada et al, "4.2: TFT–LCDs Using Newly Designed 6–bit Digital Data Drivers", SOD 93 Digest.

*Primary Examiner*—Mark R. Powell
*Assistant Examiner*—Matthew Luu
*Attorney, Agent, or Firm*—Nixon & Vanderhye, P.C.

[57] ABSTRACT

The active matrix type display apparatus of this invention includes a display medium made of an electro-optical material; a pair of substrates opposing each other with the display medium interposed therebetween; a plurality of pixel electrodes formed in a matrix on one of the substrates; a plurality of row electrodes; a plurality of column electrodes; switching devices each of which is disposed so as to correspond to each of the pixel electrodes, connects the corresponding pixel electrode to the column electrode corresponding to the pixel electrode, and is connected to the row electrode corresponding to the pixel electrode through a control terminal thereof; a row electrode driving circuit for applying a voltage to each of the row electrodes so that the corresponding switching device become conductive only in a row electrode scanning term during a horizontal scanning term assigned to each of the row electrodes; a column electrode driving circuit for alternately applying two kinds of voltages to each of the column electrodes repeatedly at a duty ratio in accordance with a display data corresponding to each of the column electrodes; and voltage switching inhibition element for inhibiting switching of the voltages to be applied to each of the column electrodes by the column electrode driving circuit at least in part of a horizontal scanning term that is not assigned as the row electrode scanning term of any of the row electrodes.

11 Claims, 20 Drawing Sheets

DISPLAY APPARATUS

BACKGROUND OF THE INVENTION

1. Field of the Invention

The present invention relates to an active matrix type display apparatus that is capable of gray scale display by applying pulse-like voltages having different duty ratios to pixel electrodes.

2. Description of the Related Art

FIG. 18 shows an exemplified configuration of a conventional active matrix type liquid crystal display apparatus that is capable of gray scale display by using analog voltages having different voltage levels. In FIG. 18 and the following description, it is assumed for simplification that the liquid crystal display apparatus has pixels aligned in three rows and three columns.

The liquid crystal interposed display apparatus includes a pair of substrates 11 and 12 opposing each other with liquid crystal interposed therebetween. On one surface of the substrate 11 opposing the substrate 12 are formed pixel electrodes P11 through P33 made of transparent conductive films in a matrix of three rows and three columns. In the vicinity of the pixel electrodes P11 through P33 are disposed three row electrodes (gate lines) G1 through G3 and three column electrodes (source lines) S1 through S3 so that the row electrodes G1 through G3 cross the column electrodes S1 through S3 at right angles. On the respective crossings between the row electrodes G1 through G3 and the column electrodes S1 through S3 are disposed thin film transistors (TFTs) Q11 through Q33. Each of the pixel electrodes P11 through P33 is connected to the corresponding column electrode S1, S2 or S3 via the source and the drain of one of the TFTs Q11 through Q33 corresponding to the pixel electrode. The gate terminal of each of the TFTs Q11 through Q33 is connected to the corresponding row electrode G1, G2 or G3. On the entire surface of the substrate 12 opposing the substrate 11 is formed a counter electrode. Accordingly, liquid crystal cells are formed between the counter electrode on the substrate 12 and the pixel electrodes P11 through P33 on the substrate 11 by interposing the liquid crystal therebetween. As a result, the liquid crystal display apparatus is capable of the gray scale display by varying the permeability of light depending upon the voltages charged at the respective pixel electrodes P11 through P33 (i.e., potential differences with the counter electrode).

This liquid crystal display apparatus includes, as peripheral circuits, a timing controller 13, a gray scale voltage source 15, a column electrode driving circuit 16 and a row electrode driving circuit 17. The timing controller 13 receives a display data D, a vertical synchronizing signal VS, a horizontal synchronizing signal HS and a dot clock signal CLK, all of which are externally supplied, and generates various synchronizing signals. The timing controller 13 transfers the generated synchronizing signals to the gray scale voltage source 15, the column electrode driving circuit 16 and the row electrode driving circuit 17. The column electrode driving circuit 16 is supplied with the display data D as well as the synchronizing signals.

The gray scale voltage source 15 generates a plurality of analog gray scale voltages V0 through V3 having different voltage levels depending upon the respective gray levels of the gray scale display, and supplies the analog gray scale voltages V0 through V3 to the column electrode driving circuit 16. The gray scale voltage source 15 also generates a counter electrode signal VC whose voltage level is varied in each vertical scanning term TV based on a synchronizing signal supplied by the timing controller 13, and supplies the counter electrode signal VC to the counter electrode on the substrate 12.

The row electrode driving circuit 17 generates three kinds of row electrode scanning signals OG1 through OG3 that are successively activated in each horizontal scanning term TH based on the synchronizing signals supplied by the timing controller 13, and transfers each of the row electrode scanning signals OG1 through OG3 to the corresponding row electrode G1, G2 or G3. When the row electrode scanning signals OG1 through OG3 respectively output, the row electrodes G1 through G3 are activated, and the corresponding TFTs Q11 through Q33 connected to the row electrodes G1 through G3 become conductive. Therefore, for example, when the row electrode scanning signal OG2 output to the row electrode G2 is activated, all the TFTs Q21, Q22 and Q23 connected to the row electrode G2 become conductive, thereby connecting the corresponding row of pixel electrodes P21, P22 and P23 to the respective column electrodes S1 through S3.

The column electrode driving circuit 16 serial/parallel converts the display data D, that is, a digital signal, for three pixels at one time, selects one of the analog gray scale voltages V0 through V3 supplied by the gray scale voltage source 15 so as to correspond to each display data D for the three pixels, and outputs the selected voltage as column electrode driving signals OS1 through OS3 to the respective column electrodes S1 through S3 on the substrate 11 simultaneously.

FIG. 19 shows a specific exemplified configuration of the column electrode driving circuit 16. This drawing shows merely part of the circuit where a column electrode driving signal OSi is output to one column electrode Si (wherein i is 1, 2 or 3). This means that the number of such a circuit as is shown in FIG. 19 in the actual column electrode driving circuit 16 is equal to the number of the column electrodes Si. Further, it is assumed in the following description that the display data D is composed of two data bits d0 and d1 or a gray scale display with four levels.

The display data D for three pixels are successively transferred in serial from the timing controller 13 to the column electrode driving circuit 16 in one horizontal scanning term TH, whereas the two data bits d0 and d1 in the display data D for one pixel are transferred to the column electrode driving circuit 16 in parallel. The data bits d0 and d1 are latched in a sample latch circuit **16*a* in response to a sampling pulse TSi. The sampling pulse TSi is one of the synchronizing signals supplied by the timing controller 13, and in the display apparatus of FIG. 18, three sampling pulses TS1 through TS3 are transferred by the timing controller 13. The sampling pulses TS1 through TS3 successively rise every time the display data D for one pixel is supplied. This is repeated in each horizontal scanning term TH in which the display data D for three pixels are supplied. The data bits d0 and d1 latched in the sample latch circuit 16*a* are latched in a hold latch circuit 16*b* in response to a hold pulse OE. The hold pulse OE is also one of the synchronizing signals supplied by the timing controller 13 and rises once in each horizontal scanning term TH. Therefore, the data bits d0 and d1 for three pixels transferred in one horizontal scanning term TH are successively latched in the sample latch circuit 16*a* and simultaneously latched in the hold latch circuit 16*b*** so as to be serial/parallel converted.

The data bits d0 and d1 latched in the hold latch circuit **16*b* are transferred to a decoder circuit 16*c*. The decoder circuit 16***c* activates one of four outputs S0 through S3 in accordance with the digital values of the data bits d0 and d1 received as inputs D0 and D1. The four outputs S0 through S3 are transferred to the control input terminals of four analog switches ASW0 through ASW3, respectively. The analog switches ASW0 through ASW3 select one of the analog gray scale voltages V0 through V3 supplied by the gray scale voltage source 15 in accordance with the outputs S0 through S3 of the decoder circuit 16*c*, and output the selected voltage as the column electrode driving signal OSi. The column electrode driving signal OSi is supplied to the corresponding column electrode Si.

The operation of such a liquid crystal display apparatus will now be described based on a timing diagram shown in FIG. 20.

Since the pixel electrodes P11 through P33 are aligned in the matrix with the three rows and the three columns, one period of the vertical synchronizing signal VS includes three periods of the horizontal synchronizing signal HS. One period of the horizontal synchronizing signal VS corresponds to a vertical scanning term TV and one period of the horizontal synchronizing signal HS corresponds to a horizontal scanning term TH. The display data D for three pixels are transferred in each horizontal scanning term TH, and the display data D for all the pixel electrodes P11 through P33 (which are denoted by reference numerals D11 through D33 in FIG. 20 for the convenience of the description) are transferred in one horizontal scanning term TV.

The column electrode driving signals OS1 through OS3 output to the column electrodes S1 through S3 correspond to the analog gray scale voltages V0 through V3 corresponding to the respective display data D11 through D33. For example, the column electrode driving signal OS2 is one of the analog gray scale voltages V0 through V3 corresponding to the display data D12, D22 and D32, and is switched in each horizontal scanning term TH. Further, the column electrode driving signal OS2 is one of he analog gray scale voltages V0 through V3 corresponding to, for example, the display data D12 in a horizontal scanning term TH subsequent to a horizontal scanning term TH when the display data D12 is transferred to the column electrode driving circuit 16.

Any one of the row electrode scanning signals OG1 through OG3 output to the row electrodes G1 through G3 successively undergoes a low to high transition in each horizontal scanning term TH. Specifically, the first row electrode scanning signal OG1 is at a high level in a second horizontal scanning term TH in one vertical scanning term TV, the second row electrode scanning signal OG2 is at a high level in a third horizontal scanning term TH in the same vertical scanning term TV, and the third row electrode scanning signal OG3 is at a high level in a first horizontal scanning term TH in the subsequent horizontal scanning term TV. Such level changes are repeated in each vertical scanning term TV, whereas the row electrode scanning signals OG1 through OG3 are actually at a high level not in the entire horizontal scanning term TH but in a row electrode scanning term TG that accounts for a great part of the horizontal scanning term TH.

The analog gray scale voltages V0 through V3 are driving signal having different fixed voltage levels. The voltage levels of the analog gray scale voltages V0 through V3 can be switched in each vertical scanning term TV so as to be inverted at the height. Also, the counter electrode signal VC supplied to the counter electrode on the substrate 12 is a driving signal having a desired voltage level, and can be switched between higher and lower potentials in each vertical scanning term TV. The absolute value of a potential difference between the counter electrode signal VC and each of the analog gray scale voltages V0 through V3 is constant, respectively, and merely the polarity of the potential difference is inverted in each vertical scanning term TV. Accordingly, a voltage whose polarity is inverted in each vertical scanning term TV is applied between each of the pixel electrodes P11 through P33 on the substrate 11 and the counter electrode on the substrate 12. Such AC drive prevents the liquid crystal from degrading. As alternative AC drive, the counter electrode signal VC is always kept at a fixed voltage level, and the voltage levels of the analog gray scale voltages V0 through V3 alone are switched to be symmetrical about the fixed voltage level.

Now, the case where the display data D22 corresponds to the analog gray scale voltage V2 will be exemplified. Since a potential difference between the analog gray scale voltage V2 and the counter electrode signal VC is applied between the pixel electrode P22 and the counter electrode in a row electrode scanning term TG when the row electrode scanning signal OG2 is at a high level, the voltage waveform at the pixel electrode P22 is obtained, by using the potential of the counter electrode as a reference, as is shown as a waveform VP22 in FIG. 20. Specifically, in the row electrode scanning term TG when the row electrode scanning signal OG2 is at a high level, the TFT Q22 is conductive so that the pixel electrode P22 charged/discharged to have a voltage level defined by the analog gray scale voltage V2. Then, this voltage level is maintained until the row electrode scanning signal OG2 is activated again by cutting off the TFT Q22. When the row electrode scanning signal OG2 is activated again, the pixel electrode P22 is charged/discharged to have a reverse voltage level with the same absolute value. This procedure is repeated thereafter.

In this conventional liquid crystal display apparatus, the four kinds of analog gray scale voltages V0 through V3 are generated in the gray scale voltage source 15, and the number of the kinds of the voltages is equal to the number of the levels of the gray scale display. These analog gray scale voltages V0 through V3 are, however, generated in an analog circuit generally including a combination of an operational amplifier, a transistor for current amplification and the like. Therefore, such an analog circuit occupies large part in the entire driving circuit not only in the mounting space but also in the production cost. In addition, when the number of the levels of the gray scale display is increased, a larger number of kinds of analog gray scale voltages are required, resulting in making this problem more serious. Moreover, the number of the analog switches ASW0 through ASW3 as shown in FIG. 19 required for each of the column electrodes S1 through S3 in the column electrode driving circuit 16 is identical to the number of the levels of the gray scale display, i.e., four in the aforementioned description. Such a large number of analog switches also occupy a large space in each chip. Further, the number of the analog switches ASW is accumulatively increased when the number of the levels of the gray scale display is increased or when the number of the column electrodes is increased to attain high resolution.

In order to solve the above-mentioned problems, an active matrix type liquid crystal display apparatus for the gray scale display has been conventionally developed in which pulse-like voltages having different duty ratios are applied to pixel electrodes.

An equivalent circuit for one pixel in such an active matrix type liquid crystal display apparatus is shown in FIG.

21. As is shown in FIG. 21, a pixel capacitance CP, which is formed by a pixel electrode P and a counter electrode together with liquid crystal sandwiched therebetween, is connected to a column electrode S via the source and the drain of a TFT Q whose gate is connected to a row electrode G. A circuit diagram as is shown in FIG. 22 can be obtained when the ON resistance of the TFT Q is indicated by RON, and the capacitance of the column electrode S and the distributed capacitance between the column electrode S and the counter electrode are respectively indicated by a column electrode resistance RS and a column electrode capacitance CS, which are concentrated constants thereof. Now, a circuit composed of the ON resistance RON and the pixel capacitance CP and a circuit composed of the column electrode resistance RS and the column electrode capacitance CS will be studied. When a voltage V is applied in a stepwise manner to such a series circuit composed of a resistance R and a capacitance C, the terminal voltage v of the capacitance C is varied with time t as represented by the following equation 1:

$$v(t) = V(1 - e^{-\frac{t}{RC}}) \qquad \text{Equation 1:}$$

The time constant in this case is a product RC of the resistance R and the capacitance C. Further, when the terminal voltage V of the capacitance C is regarded as the output of this circuit, this circuit can be considered to have a low-pass filter characteristic in accordance with the time constant RC, and hence, the circuit has a function to smooth and average an input voltage. Accordingly, when a pulse signal in which two kinds of voltages VSH and VSL are alternately repeated as is shown in FIG. 23 is applied to this circuit, the capacitance C is charged with an average voltage obtained by averaging the voltages VSH and VSL on the basis of a duty ratio m:n of the pulse signal as represented by equation 2, if the time constant RC is sufficiently long as compared with a period T of the pulse signal:

$$\frac{m\,VSH + n\,VSL}{T} \qquad \text{Equation 2:}$$

This means that, as is shown in FIG. 24, the terminal voltage V shown with a heavy line is gradually averaged through the repeat of charge/discharge. When the value of m of the duty ratio m:n of the pulse signal is large, the terminal voltage v is averaged to be at a high voltage level, and when the value of m is small, it is averaged to be at a low voltage level. When the voltage to be charged in the pixel capacitance CP is varied by applying such pulse signals having different duty ratios to the column electrode S, the gray scale display can be realized without using an analog gray scale voltage by merely supplying the two kinds of voltages VSH and VSL.

In an actually used liquid crystal display apparatus, although the ON resistance RON is generally larger than the column electrode resistance RS and the pixel capacitance CP is generally smaller than the column electrode capacitance CS, the time constant RON×CP of the ON resistance RON and the pixel capacitance CP is sufficiently longer than the time constant RS×CS of the column resistance RS and the column electrode capacitance CS. Therefore, the charging/discharging characteristic in the case where the pixel capacitance CP is charged/discharged is defined not by the time constant RS×CS of the column electrode S but by the time constant RON×CP in each pixel.

An exemplified configuration of the conventional liquid crystal display apparatus using the application of such a pulse-like voltage is shown in FIG. 25. This liquid crystal display apparatus has substantially the same configuration as that shown in FIG. 18, and hence, the same reference numerals are used to refer to elements having the same function and the description thereof is omitted.

This liquid crystal display apparatus includes a gray scale signal generating circuit 14 for generating four kinds of gray scale pulse signals GS0 through GS3 based on a synchronizing signal transferred by the timing controller 13. The gray scale pulse signals GS0 through GS3 are supplied to the column electrode driving circuit 16. The gray scale voltage source 15 supplies, instead of the analog gray scale voltages V0 through V3, the two kinds of voltages VSH and VSL to the column electrode driving circuit 16.

The gray scale signal generating circuit 14 includes, as is shown in FIG. 26, four pulse signal generating circuits 1 and four EXNOR circuits 3. The four pulse signal generating circuits 1 generate four kinds of pulse signals SP0 through SP3 having the same period but different duty ratios based on a clock signal CK and a reset signal RES transferred by the timing controller 13. The pulse signals SP0 through SP3 are transferred to one input terminal of the corresponding EXNOR circuit 3. The other input terminal of the EXNOR circuit 3 is supplied with an AC driving signal AD that is transferred by the timing controller 13 and is inverted in each vertical scanning term TV. The EXNOR circuit 3 calculates an exclusive OR of each of the pulse signals SP0 through SP3 and the AC driving signal AD, and outputs one of the gray scale pulse signals GS0 through GS3 that have different duty ratios and are inverted (i.e., made into an inverse) in each vertical scanning term TV, as is shown in FIG. 28 described in detail below.

A specific exemplified configuration of the column electrode driving circuit 16 supplied with the gray scale pulse signals GS0 through GS3 is shown in FIG. 27. Similarly to FIG. 19, this drawing also shows merely part of the circuit where a column electrode driving signal OSi is output to one column electrode Si, and it is also assumed that display data D is composed of two data bits d0 and d1.

The Sample latch circuit 16*a*, the hold latch circuit 16*b* and the decoder circuit 16*c* have the same functions as those used in the column electrode driving circuit 6 of FIG. 19, and hence, the description thereof is omitted. The four outputs of the decoder circuit 16*c* are transferred to one input terminal of each of four AND circuits 16*d*. Each AND circuit 16*d* selects one of the four gray scale pulse signals GS0 through GS3 in accordance with the outputs S0 through S3 of the decoder circuit 16*c* and outputs the selected signal. The outputs of the respective AND circuits 16*d* are put together at a four-input NOR circuit 16*e* to be transferred to the input terminal of a buffer circuit 16*f*. The buffer circuit 16*f* converts one of the gray scale pulse signals GS0 through GS3 at a logical level transferred through the four-input NOR circuit 16*e* into a column electrode driving signal OSi that is applicable to drive the column electrodes S1 through S3, and outputs the converted signal. Therefore, in the column electrode driving signal OSi, the voltages VSH and VSL supplied by the gray scale voltage source 15 are alternately repeated at the same duty ratio as that of the selected gray scale pulse signal GS0, GS1, GS2 or GS3. The column electrode driving signal OSi is output to the corresponding column electrode Si.

The operation of this liquid crystal display apparatus will now be described based on a timing diagram shown in FIG. 28. With regard to the vertical synchronizing signal VS, the horizontal synchronizing signal HS, the display data D, the column electrode driving signals OS1 through SO3 and the row electrode scanning signals OG1 through OG3, the above description referring to FIG. 20 is applicable, and hence the description is omitted.

The gray scale pulse signals GS0 through GS3 are pulse signals having the same period but different duty ratios, and are also switched to have inverted duty ratios in each vertical scanning term TV for the AC drive. Also the counter electrode signal VC corresponding to these pulse signals is switched to have two kinds of voltages approximate to the voltages VSH and VSL in each vertical scanning term TV.

The case where the display data D22 has a value corresponding to the gray scale pulse signal GS2 will be herein exemplified. In a row electrode scanning term TG when the row electrode scanning signal OG2 is at a high level, a potential difference between the counter electrode signal VC and the column electrode driving signal OS2, in which the voltages VSH and VSL are alternately repeated at the same duty ratio as that of the gray scale pulse signal GS2, is applied to the pixel electrode P22. Accordingly, the voltage waveform at the pixel electrode P22 is obtained, by using the potential at the counter electrode as a reference, as is shown as a waveform VP22 in FIG. 28. A charging/discharging circuit composed of the conductive TFT Q22 end the pixel electrode P22 has a charging/discharging characteristic defined by the time constant RON×CP, and hence, the oscillating voltage is averaged. Therefore, when the pixel electrode P22 is alternately supplied with the voltages VSH and VSL, the voltage waveform VP22, in consideration of the actual low-pass filter characteristic, is averaged in accordance with the duty ratio of the gray scale pulse signal GS2 as is shown with a heavy line in FIG. 28. The averaged voltage level is maintained until the row electrode scanning signal OG2 is activated again by cutting off the TFT Q22. When the row electrode scanning signal OG2 is activated again, the pixel electrode P22 is charged/discharged to have a voltage level having the same absolute value and reverse polarity. This procedure is repeated thereafter.

As a result, in the conventional liquid crystal display apparatus shown in FIG. 25, the gray scale voltage source 15 merely supplies the two kinds of voltages VSH and VSL regardless of the number of the levels of the gray scale display. In addition, the analog switches ASW in the column electrode driving circuit 16 of FIG. 19 are replaced with a digital circuit composed of the AND circuits 16*a*, the four-input NOR circuit 16*e* and the buffer circuit 16*f* as shown in FIG. 27. Therefore, the problem caused by the analog circuit for the gray scale display that it requires a high cost and a large area for mounting parts can be overcome.

The periods of the gray scale pulse signals GS0 through GS3 are set to be sufficiently short as compared with the time constant RON×CP of the charging/discharging circuits of the pixel electrodes P11 through P33 of FIG. 22, so that the oscillating voltages of the column electrode driving signals OS1 through OS3 can be averaged without fail. Accordingly, when such oscillating voltages are applied to the column electrodes S1 through S3, the charging/discharging currents flowing through the charging/discharging circuits of the pixel electrodes P11 through P33 are directly decreased. The oscillating voltages, however, are also applied to the charging/discharging circuits of the column electrode capacitances CS of the column electrodes S1 through S3. The time constant RS×CS of the charging/discharging circuits of the column electrodes S1 through S3 is much shorter than the time constant RON×CP of the charging/discharging circuits of the pixel electrodes P11 through P33. In the case where the time constant RC is shorter than the period T as is shown in FIG. 29, the terminal voltage v cannot be averaged but continues to oscillate, thereby allowing the charging/discharging current to continuously flow. Therefore, when the oscillating voltages of the column electrode driving signals OS1 through OS3 are applied to the column electrodes S1 through S3, the charging/discharging currents repeatedly flow through the charging/discharging circuits of the column electrodes S1 through S3 having the shorter time constant RS×CS.

As a result, the conventional liquid crystal display apparatus using the application of the pulse-like voltage has a problem that large power is required since the charging/discharging currents wastefully flow through the column electrode capacitances CS of the column electrodes S1 through S3.

SUMMARY OF THE INVENTION

The active matrix type display apparatus of this invention comprises a display medium made of an electro-optical material; a pair of substrates opposing each other with the display medium interposed therebetween; a plurality of pixel electrodes formed in a matrix on one of the substrates; a plurality of row electrodes each of which is disposed so as to correspond to each row of the pixel electrodes in the matrix; a plurality of column electrodes each of which is disposed so as to correspond to each column of the pixel electrodes in the matrix; switching devices each of which is disposed so as to correspond to each of the pixel electrodes, connects the corresponding pixel electrode to the column electrode corresponding to the pixel electrode, and is connected to the row electrode corresponding to the pixel electrode through a control terminal thereof; a row electrode driving circuit for applying a voltage to each of the row electrodes so that the corresponding switching device becomes conductive only in a row electrode scanning term during a horizontal scanning term assigned to each of the row electrodes; a column electrode driving circuit for alternately applying two kinds of voltages to each of the column electrodes repeatedly at a duty ratio in accordance with a display data corresponding to each of the column electrodes; and voltage switching inhibition means for inhibiting switching of the voltages to be applied to each of the column electrodes by the column electrode driving circuit at least in part of a term that is not assigned as the row electrode scanning term of any of the row electrodes.

In one embodiment, the column electrode driving circuit comprises pulse signal generating circuits for generating plural kinds of pulse signals having different duty ratios; a pulse signal selecting circuit for selecting one of the pulse signals in accordance with the display data corresponding to each of the column electrodes; and a voltage switching circuit for switching a voltage to be applied to each of the column electrodes between the two kinds of voltages in accordance with the selected pulse signal. The voltage switching inhibition means masks the plural pulse signals generated by the pulse signal generating circuits over substantially the entire term that is not assigned as the row electrode scanning term of any of the row electrodes, so that the pulse signals have a constant voltage level, and transfers the masked signals to the pulse signal selecting circuit.

In one embodiment, the column electrode driving circuit varies a switching period for the voltages to be applied to each of the column electrodes in each horizontal scanning term, so that the switching period becomes shorter at the end of each row electrode scanning term than at least at the beginning of the row electrode scanning term, and the display apparatus further comprises voltage switching period shortening means for not increasing the switching period in the row electrode scanning term.

Alternatively, the active matrix type display apparatus of this invention comprises a display medium made of an electro-optical material; n pair of substrates opposing each other with the display medium interposed therebetween; a plurality of pixel electrodes formed in a matrix on one of the substrates; a plurality of row electrodes each of which is disposed so as to correspond to each row of the pixel electrodes in the matrix; a plurality of column electrodes each of which is disposed so as to correspond to each column of the pixel electrodes in the matrix; switching devices each of which is disposed so as to correspond to each of the pixel electrodes, connects the corresponding pixel electrode to the column electrode corresponding to the pixel electrode, and is connected to the row electrode corresponding to the pixel electrode through a control terminal thereof; a row electrode driving circuit for applying a voltage to each of the row electrodes so that the corresponding switching device becomes conductive only in m row electrode scanning term during a horizontal scanning term assigned to each of the row electrodes; a column electrode driving circuit for alternately applying two kinds of voltages to each of the column electrodes repeatedly at a duty ratio in accordance with a display data corresponding to each of the column electrodes; and voltage switching period shortening means for varying a switching period for the voltages to be applied to each of the column electrodes in each horizontal scanning term, so that the switching period become shorter at the end of each row electrode scanning term than at least at the beginning of the row electrode scanning term, and for not increasing the switching period in the row electrode scanning term.

In one embodiment, the column electrode driving circuit comprises pulse signal generating circuits for generating plural pulse signals having different duty ratios; a pulse signal selecting circuit for selecting one of the pulse signals in accordance with the display data corresponding to each of the column electrodes; and a voltage switching circuit for switching a voltage to be applied to each of the column electrodes between the two kinds of voltages in accordance with the selected pulse signal, and the voltage switching period shortening means varies a switching period for the voltages to be applied to the column electrodes in each horizontal scanning term, so that the switching period become shorter at the end of each row electrode scanning term than at least at the beginning of the row electrode scanning term, and does not increase the switching period in the row electrode scanning term.

In one embodiment, the voltage switching period shortening means shortens the switching period for the two kinds of voltages in a stepwise manner in each row electrode scanning term.

In one embodiment, the voltage switching period shortening means steplessly shortens the switching period for the two kinds of voltages in each row electrode scanning term.

In one embodiment, the voltage switching period shortening means steplessly shortens the switching period for the two kinds of voltages up to an intermediate point in each row electrode scanning term and make the switching period constant thereafter.

In one embodiment, the electro-optical material is liquid crystal.

In the active matrix type display apparatus of the invention, one vertical scanning term includes the horizontal scanning terms the number of which exceeds the number of the row electrodes. Each horizontal scanning term is assigned to each row electrode so as not to overlap with the other row electrodes, and a row electrode scanning term is included in the assigned horizontal scanning term. The row electrode driving circuit scans the row electrodes by applying a voltage to each of the row electrodes to make the corresponding switching device conductive merely in the row electrode scanning term for each of the row electrodes. The scan of the row electrodes by the row electrode driving circuit is repeated at periods of the vertical scanning term. The column electrode driving circuit alternately applies the two kinds of voltages repeatedly to each of the column electrodes at a duty ratio in accordance with the display data for the column electrode.

A display data corresponds to each of the column electrodes, and determines the gray level for the pixel electrodes in one row assigned to the current horizontal scanning term. Therefore, the display data corresponding to each column electrode is switched in each horizontal scanning term. When the electro-optical material is liquid crystal or the like, it is necessary to AC drive the voltages to be applied to the column electrodes for preventing the degradation of the liquid crystal. In such a case, the two kinds of voltages are switched so that the polarity of the voltage to be applied to a pixel electrode is inverted, for example, in each vertical scanning term.

When the two kinds of voltages are applied to the column electrode, the corresponding pixel electrodes are charged/discharged via the corresponding conductive switching device. Since the time constant of the charging/discharging circuit of the pixel electrode is sufficiently large, the two kinds of voltages are smoothed. The pixel electrode is charged with a substantially averaged voltage, and a charging/discharging current scarcely flows through the circuit. Further, the charging voltage has a level in accordance with the duty ratio of the two kinds of voltages, resulting in realizing the gray scale display. When the two kinds of voltages are applied to the column electrodes, however, the column electrode capacitances distributed in the column electrodes are also charged/discharged. Since the time constant of the charging/discharging circuit of the column electrode is smaller than the time constant o the charging/discharging circuit of the pixel electrode, a charging/discharging current repeatedly flows through the circuit every time the two kinds of voltages are switched. This can result in increasing power to be consumed in the display apparatus.

According to the invention, the voltage switching inhibition means inhibits the switching of the voltages to be applied to the column electrodes by the column electrode driving circuit at least in part of a term that is not assigned as a row electrode scanning term of any of the row electrodes. The term that is not assigned as a row electrode scanning term of any of the row electrodes corresponds to the first and the last portions of each horizontal scanning term that are not included in a row electrode scanning term when the row electrode scanning term does not occupy the entire horizontal scanning term, and also corresponds to the first and the last horizontal scanning terms in one vertical scanning term that are not assigned to any of the column electrodes. Such a term is regarded as a non-drive term when the two kinds of voltage to be applied to the column electrodes do not make any contribution to the charge of the pixel electrodes. The voltage switching inhibition means inhibits the switching of the voltages in part of or over the entire non-drive term. In addition, it is possible to inhibit the switching of the voltages in part of the row electrode scanning term, in particular, in a predetermined portion at the beginning of the row electrode scanning term, as far as the inhibition does not affect the charge of the pixel electrodes. In a conventional display apparatus, the two kinds of voltages are alternately applied to the column electrodes over the entire non-drive term, end therefore, the column electrode capacitance is wastefully charged/discharged. In the present invention, however, since the switching of the voltages during the non-drive term is inhibited, the waste of the power can be avoided. Further, even though the switching of the voltages are stopped in the non-drive term in this manner, the charge of the pixel electrodes is not affected.

Furthermore, the voltage switching inhibition means substantially masks the pulse signals for controlling the switching of the two kinds of voltages to be applied to the column electrodes over the entire non-drive term.

Moreover, the voltage switching period shortening means varies the switching period for the two kinds of voltages to be applied to the column electrodes in each vertical scanning term. The switching period is varied so as to be shorter at the end of each row electrode scanning term at least than at the beginning of the row electrode scanning term. In this case, such variation can be made over the entire horizontal scanning term. Now, the following two cases will be compared: one is the case where the switching period in one row electrode scanning term is constant; and the other is the case where the switching period at the end of one row electrode scanning term is shortened to be equal to or slightly shorter than the constant period. Since the switching period at the beginning of the row electrode scanning term is longer in the latter case, the number of times of switching the voltages is smaller. Therefore, the number of times of charging/discharging the column electrode capacitance of the column electrode is also smaller. Thus, the waste of the power due to the charge/discharge of the column electrode capacitance can be decreased in the latter case. Further, when the switching period is longer at the beginning of the row electrode scanning term, the two kinds of voltages cannot be sufficiently smoothed although the time constant of the charging/discharging circuit of the pixel electrode is large. When the switching period is appropriately shortened thereafter, the voltages can be sufficiently smoothed at the end of the row electrode scanning term. Therefore, the charge/discharge of the pixel electrode is not affected.

The switching period is varied not to be increased at least in the row electrode scanning term. This means that the switching period is shortened or not varied at all with time. Such variation of the switching period includes, for example, stepwise shortening and stepless shortening (monotonic decrease). Further, the switching period can be steplessly shortened up to an intermediate point of the row electrode scanning term and maintained constant thereafter.

Further, in the present invention, the voltage switching period shortening means can vary the switching period by controlling the period of a pulse signal for controlling the switching of the two kinds of voltages to be applied to the column electrodes;

When the display apparatus comprises both the voltage switching inhibition means and the voltage switching period shortening means, not only the wasteful charge/discharge of the column electrode capacitance can be avoided in the non-drive term that makes no contribution to the charge of the pixel electrode, but also the number of the times of wastefully charging/discharging the column electrode capacitance during the row electrode scanning term can be decreased. As a result, such a display apparatus can more effectively decrease the power to be consumed.

Thus, the invention described herein makes possible the advantages of providing a display apparatus for the gray scale display through the application of a pulse-like voltage that consumes less power, while maintaining a characteristic of a conventional display apparatus using an analog gray scale voltage that circuit scale is not increased.

These and other advantages of the present invention will become apparent to those skilled in the art upon reading and understanding the following detailed description with reference to the accompanying figures.

DESCRIPTION OF THE PREFERRED EMBODIMENTS

The present invention will now be described by way of examples.

EXAMPLE 1

Figure 1:
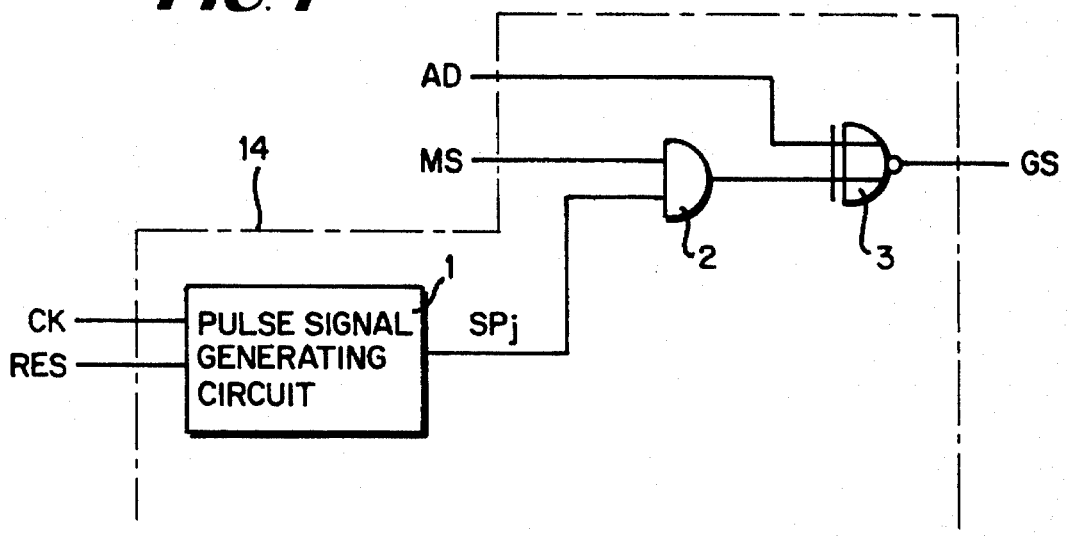
FIG. 1 is a block diagram showing the configuration of a gray scale signal generating circuit used in a liquid crystal display apparatus according to Example 1 of the invention.
Figure 2:
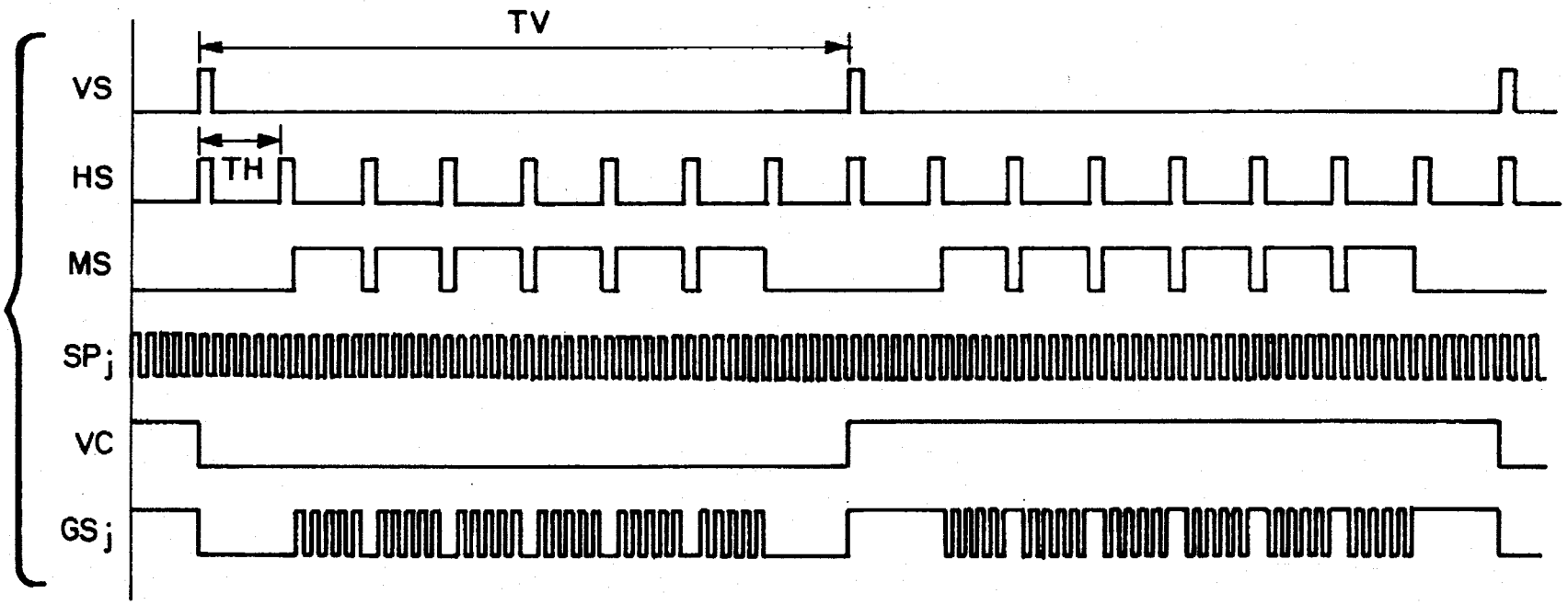
FIG. 2 is a timing diagram showing the operation of the gray scale signal generating circuit of FIG. 1.
Figure 3:
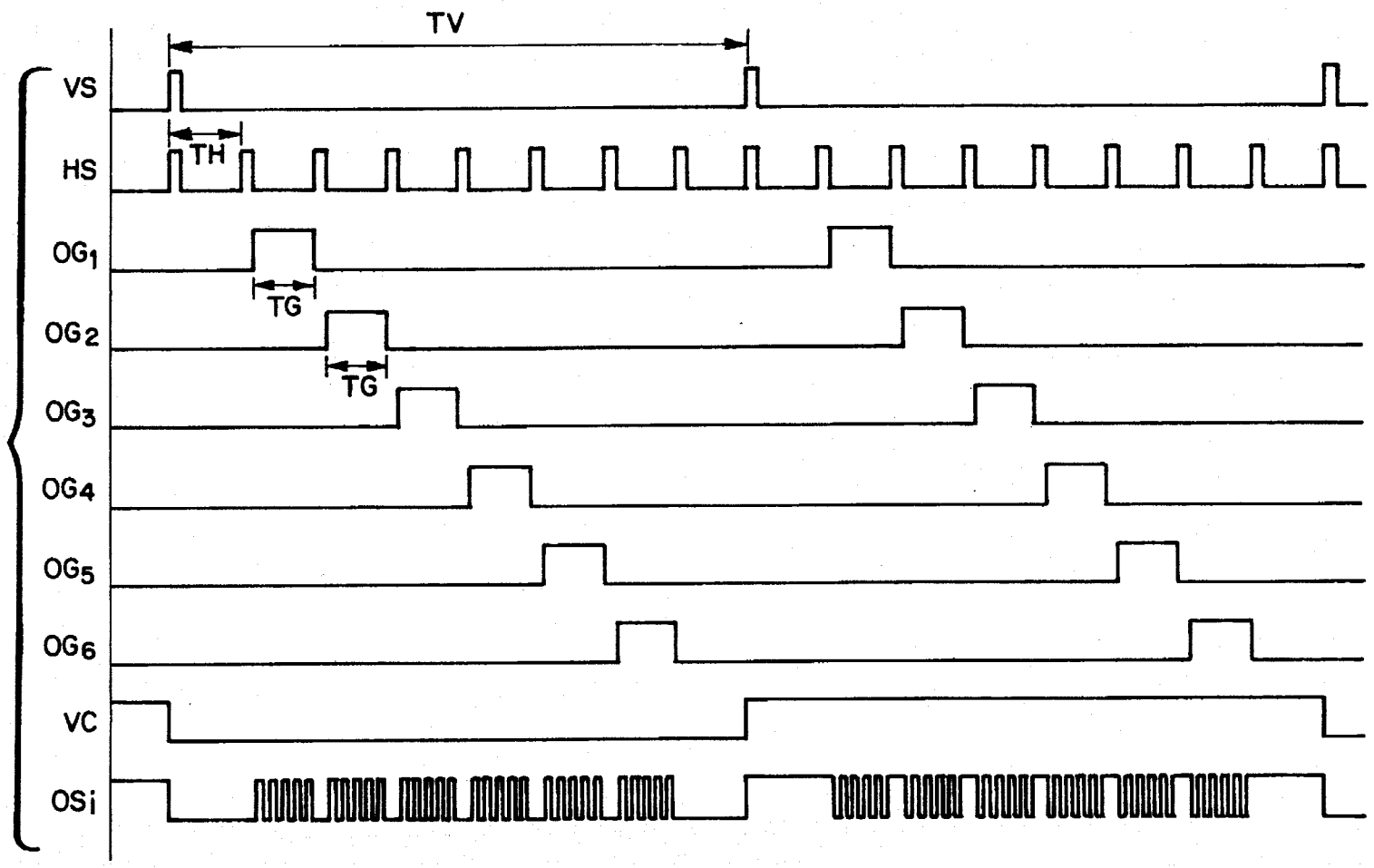
FIG. 3 is a timing diagram showing the operation of the liquid crystal display apparatus according to Example 1 of the invention.
Figure 25:
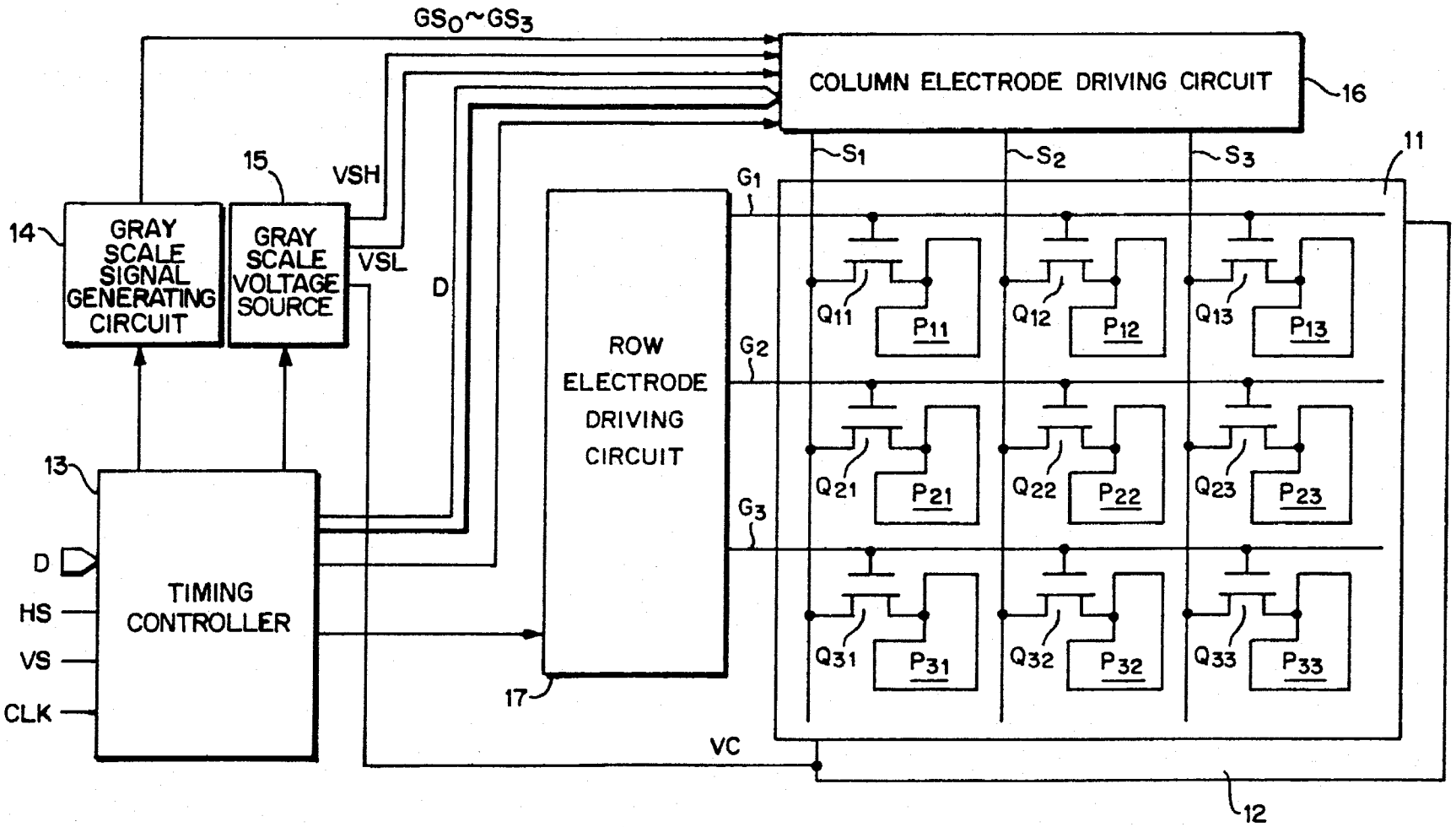
FIG. 25 is a block diagram showing the configuration of a second conventional liquid crystal display apparatus.
Figure 27:
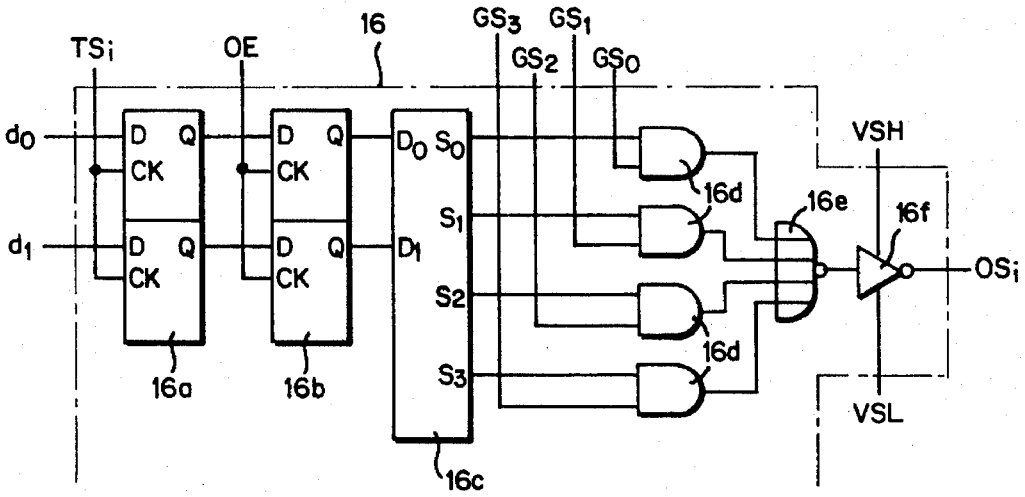
FIG. 27 is a block diagram showing the configuration of a column electrode driving circuit used in the liquid crystal display apparatus of FIG. 25.
Figure 28:
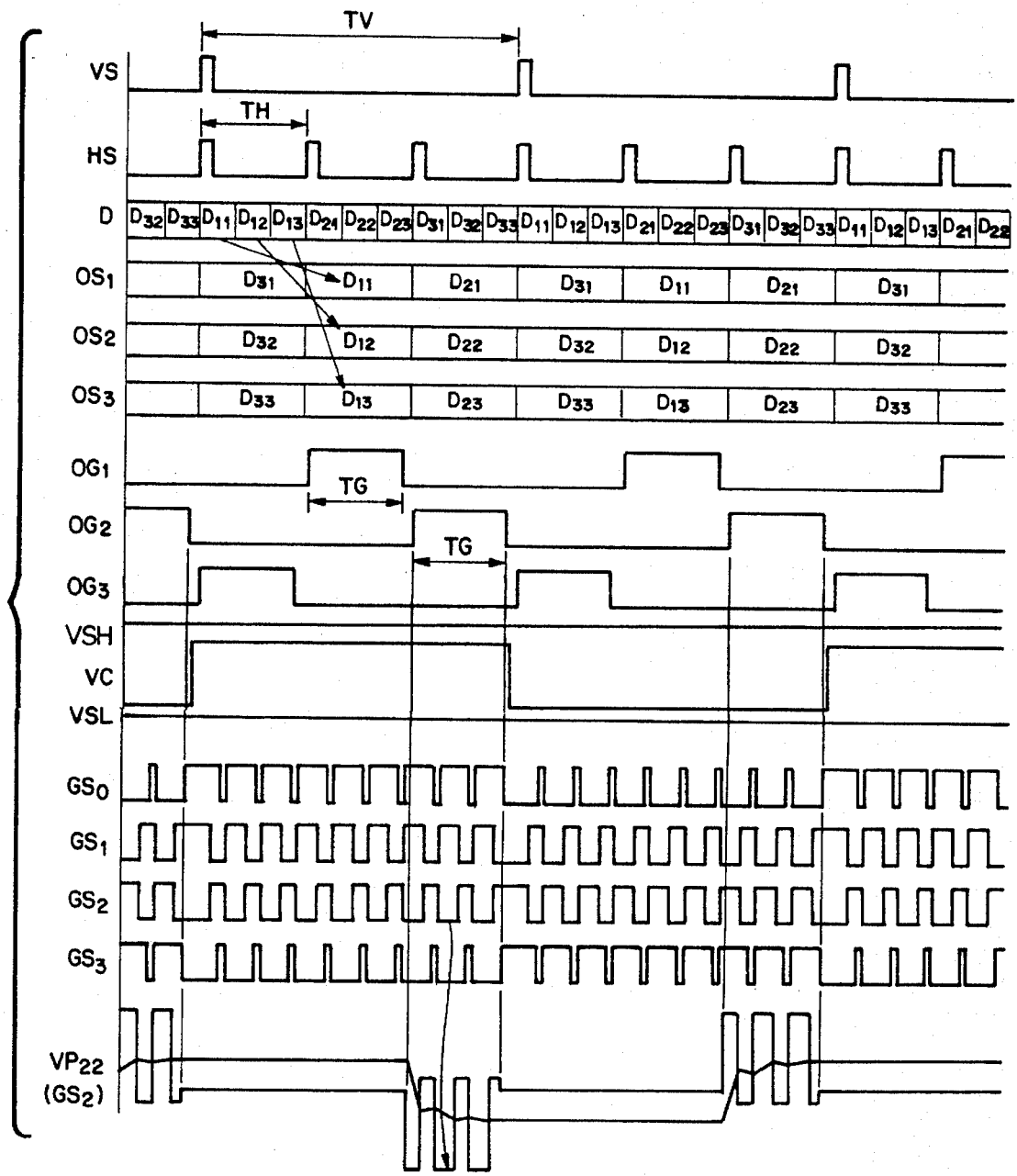
FIG. 28 is a timing diagram showing the operation of the liquid crystal display apparatus of FIG. 25.
Figure 29:
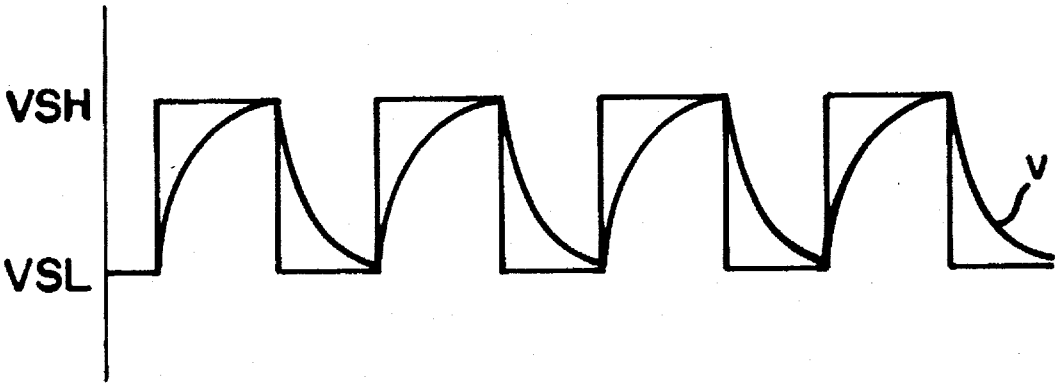
FIG. 29 is a timing diagram showing the averaging of pulse signals in a charging/discharging circuit having a shorter time constant.

An active matrix type liquid crystal display apparatus of this example will be described in detail. The general configuration of this liquid crystal display apparatus is identical to that shown in FIG. 25, and the configuration of a column electrode driving circuit 16 is also identical to that shown in FIG. 27. The liquid crystal display apparatus, however, includes a gray scale signal generating circuit 14 having a different configuration from that of the conventional display apparatus. FIG. 1 is a block diagram showing the configuration of the gray scale signal generating circuit 14 of this example, FIG. 2 is a timing diagram showing the operation of this gray scale signal generating circuit 14, and FIG. 3 is a timing diagram showing the operation of the liquid crystal display apparatus of Example 1. The same reference numerals are used to refer to the same elements used in the conventional liquid crystal display apparatus, and the description thereof is omitted, In the following description, the case where pixel electrodes P are formed in six rows and si row electrodes G1 through G6 are formed on a substrate 11 will be exemplified for the convenience of the description. Therefore, a row electrode driving circuit 17 outputs row electrode scanning signals OG1 through OG6 to the row electrodes G1 through G6, respectively.

The gray scale signal generating circuit 14 includes plural sets of a pulse signal generating circuit 1, an AND circuit 2 and an EXNOR circuit 3 as is shown in FIG. 1, and the number of the sets is equal to the number of levels of the gray scale display although FIG. 1 shows merely one set of the pulse signal generating circuit 1, the AND circuit 2 and the EXNOR circuit 3. Each pulse signal generating circuit 1 generates, in accordance with a clock signal CK and a reset signal RES supplied by a timing controller 13, a pulse signal SPj having the same period as but a different duty ratio from those of pulse signals generated by the other pulse signal generating circuits. As the clock signal CK, a dot clock signal CLK or the like supplied by an external computer is used, and as the reset signal RES, a horizontal synchronizing signal HS or the like is used. Each pulse signal generating circuit 1 generates the pulse signal SPj having a period, for example, five times as long as that of the clock signal CK. One of the pulse signal generating circuits 1 for generating a pulse signal SP0 inverts the pulse signal SP0 to have a smaller duty ratio after the first period of the clock signal CK. Another pulse signal generating circuit 1 for generating a pulse signal SP1 inverts the pulse signal SP1 to have a larger duty ratio after the second period of the clock signal CK. Thus, it is possible to generate four kinds of pulse signals SP0 through SP3 that are different from one another in the duty ratios alone. Such a pulse signal generating circuit 1 can be formed with a digital circuit composed of a combination of a counter circuit, a latch circuit and the like.

The pulse signal SPj is transferred to one input terminal of the AND circuit 2. The other input terminal of the AND circuit 2 is supplied with a non-drive term mask signal MS by the timing controller 13. As is shown in FIG. 2, one vertical scanning term TV includes eight horizontal scanning terms TH. The non-drive term mask signal MS is a pulse signal that is at a high level in a term, which is slightly shorter than one horizontal scanning term TH, during each of the six horizontal scanning terms TH excluding the first and the last horizontal scanning terms in one vertical scanning term TV. The first and the last horizontal scanning terms TH in one vertical scanning term TV correspond to blanking terms neither contributing to the display nor being assigned to any of the row electrodes G1 through G6. Accordingly, each of the row electrode scanning signals OG1 through OG6 is activated in a row electrode scanning term TG during the six horizontal scanning terms TH excluding the first and the last horizontal scanning terms as shown in FIG. 3. The non-drive term mask signal MS is substantially equal to a logical OR of the row electrode scanning signals OG1 through OG6. When the pulse signal SPj is masked with the non-drive term mask signal MS in this manner, the AND circuit 2 outputs a pulse signal with a predetermined duty ratio only in a term when the non-drive term mask signal MS is at a high level, and in the other terms, it outputs the pulse signal at a low level.

The output signal of the AND circuit 2 is transferred to one input terminal of the EXNOR circuit 3. The other input terminal of the EXNOR circuit 3 is supplied with an AC driving signal AD that is generated in the timing controller 13 and inverted in each vertical scanning term TV. The EXNOR circuit 3 calculates an exclusive OR of the output signal of the AND circuit 2 and the AC driving signal AD, and outputs a signal at a high level only when the levels of these signals coincide with each other. Therefore, the EXNOR circuit 3 outputs a signal obtained by inverting the duty ratio of the output signal of the AND circuit 2 (i.e., making the duty ratio into an inverse) in each vertical scanning term TV. This signal corresponds to the gray scale pulse signal GSj shown in FIG. 2.

The gray scale signal generating circuit 14 outputs the gray scale pulse signals GSj having different duty ratios by the number equal to the number of levels of the gray scale display. Further, similarly to the column electrode driving circuit 16 of FIG. 27, only in a term when the gray scale pulse signal GSj has a predetermined duty ratio, the column electrode driving circuit 16 of this example switches the voltage between voltages VSH and VSL at the same duty ratio, thereby outputting a column electrode driving signal OSi to the column electrode Si.

In this liquid crystal display apparatus, as is shown in FIG. 3, the column electrode driving signal OSi is obtained by alternately repeating the voltages VSH and VSL only in a term almost identical to the row electrode scanning term TG when any of the row electrode scanning signals OG1 through OG6 is at a high level. In the other terms, the column electrode driving signal OSi has a voltage level corresponding to the counter electrode signal VC. Accordingly, an oscillating voltage is applied to the column electrode Si only when a TFT Q is actually conductive to charge/discharge the pixel electrode P, and in the other terms, i.e., in the non-drive terms, the oscillating voltage is not applied. The non-drive term herein means the first and the last horizontal scanning terms TH in each vertical scanning term TV and first and last short portions of each of the other horizontal scanning terms TH.

Accordingly, no oscillating voltage is applied to the column electrode S in the non-drive term that does not contribute to the charge/discharge of the pixel electrode P in the liquid crystal display apparatus of this example. As a result, it is possible to suppress the wasteful power consumed in the charge/discharge of the column electrode capacitance CS.

Figure 4:
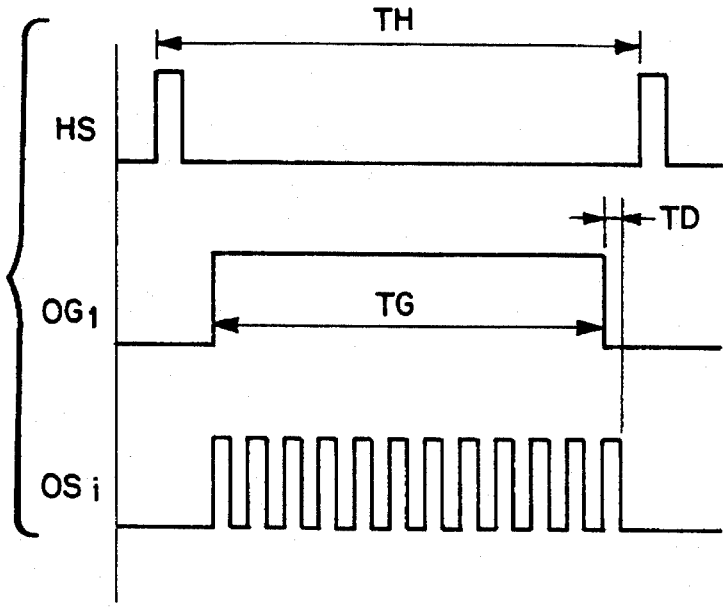
FIG. 4 is a timing diagram in which the application of an oscillating voltage is delayed for a row electrode scanning term in the liquid crystal display apparatus of Example 1.

FIG. 4 shows in detail the relationship between, for example, the row electrode scanning signal OG1 and the column electrode driving signal OSi. The row electrode scanning term TG when the row electrode scanning signal OG1 is at a high level is included in and slightly shorter than the horizontal scanning term TH. Generally, in the row electrode scanning term TG alone, the two kinds of voltages VSH and VSL are alternately repeated in the column electrode driving signal OSi. The row electrode scanning signal OG1 and the column electrode driving signal OSi are, however, slightly delayed during the transfer through the row electrode G1 and the column electrode Si, respectively. The effect of such delay can be compensated by elongating the term when the voltages are switched in the column electrode driving signal OSi so as to be longer than the row electrode scanning term TG by a delay term TD shown in FIG. 4.

Figure 5:
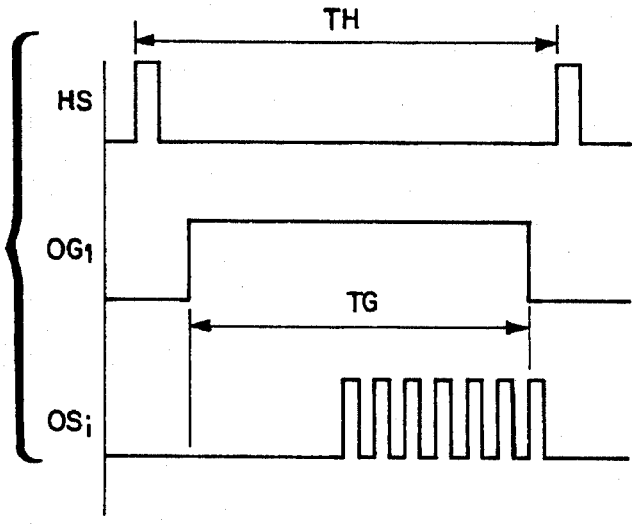
FIG. 5 is a timing diagram in which the application of the oscillating voltage is inhibited in the former half of a row column electrode scanning term in the liquid crystal display apparatus of Example 1.

Further, in the case where the row electrode scanning term TG has a sufficient length as charging time for the pixel electrode P, the switching between the two kinds of voltages VSH and VSL in the column electrode driving signal OSi can be inhibited also in the former half of the row electrode scanning term TG as shown in FIG. 5. As a result, power to be consumed can be further decreased.

In this example, the pulse signal generating circuit i generates, based on the dot clock signal CLK, the pulse signal SPj serving as e source of the gray scale pulse signal GSj. Means for generating the pulse signals having different duty ratios is not limited to this but can be one that can directly oscillate and output a pulse signal. Further, in this example, in order to simplify the circuit configuration using the AND circuit 2 alone, the pulse signal SPj generated by the pulse signal generating circuit 1 is masked by the non-drive term mask signal MS before converting into the gray scale pulse signal GSj for the AC drive by the EXNOR circuit 3. Such a process for inhibiting the oscillation of the pulse signal within a predetermined term can be conducted in any step. Furthermore, it is possible to control the two kinds of voltages VSH and VSL supplied to the column electrode driving circuit 16, thereby substantially inhibiting the switching of the voltages to be output to the column electrode Si.

EXAMPLE 2

An active matrix type liquid crystal display apparatus according to Example 2 of the invention will now be described. This liquid crystal display apparatus is identical to that of Example 1 except the configuration of a gray scale signal generating circuit 14, and hence, the description regarding the common elements is omitted. The configuration of the gray scale signal generating circuit 14 of this example is shown in the block diagram of FIG. 6.

Figure 6:
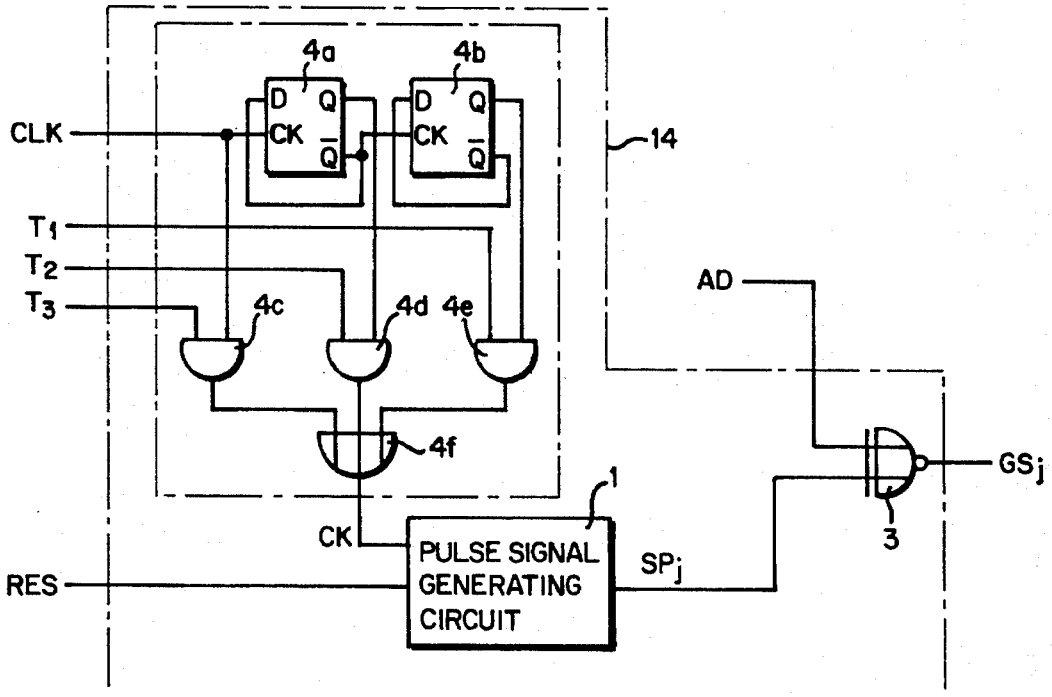
FIG. 6 is a block diagram showing the configuration of a gray scale signal generating circuit used in a liquid crystal display apparatus according to Example 2 of the invention.

The gray scale signal generating circuit 14 includes a clock period switching circuit 4 and plural sets of a pulse signal generating circuit 1 and an EXNOR circuit 3 as is shown in FIG. 6, and the number of the sets is equal to the number of levels of the gray scale display. Also, FIG. 6 shows merely one set of the pulse signal generating circuit 1 and the EXNOR circuit 3. The clock period switching circuit 4 includes two D-type flip-flop circuits 4*a* and 4*b* for successively dividing a dot clock signal CLK. One of the dot clock signal CLK and the signals divided in the respective D-type flip-flop circuit 4*a* and 4*b* is selected by using term control signals T1, T2 and T3, the selected signal is transferred as a clock signal CK to the pulse generating circuit 1 via one of three AND circuits 4*c*, 4*d* and 4*e*, and an OR circuit 4*f*.

Figure 26:
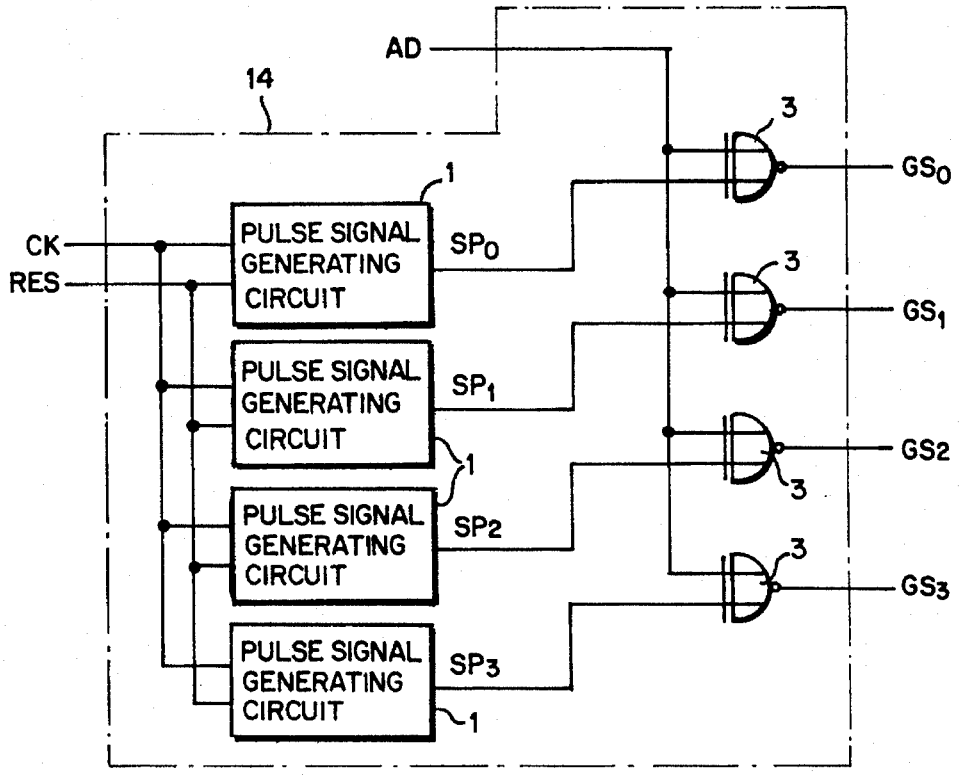
FIG. 26 is a block diagram showing the configuration of a gray scale signal generating circuit used in the liquid crystal display apparatus of FIG. 25.

Each pulse signal generating circuit 1 generates, in accordance with the clock signal CK supplied by the clock period switching circuit 4 and a reset signal RES generated in a timing controller 13, a pulse signal SPj having the same period as and a different duty ratio from those of signals generated by the other pulse signal generating circuits. The rest of the circuit configuration is the same as that of the conventional liquid crystal display apparatus shown in FIG. 26.

Figure 7:
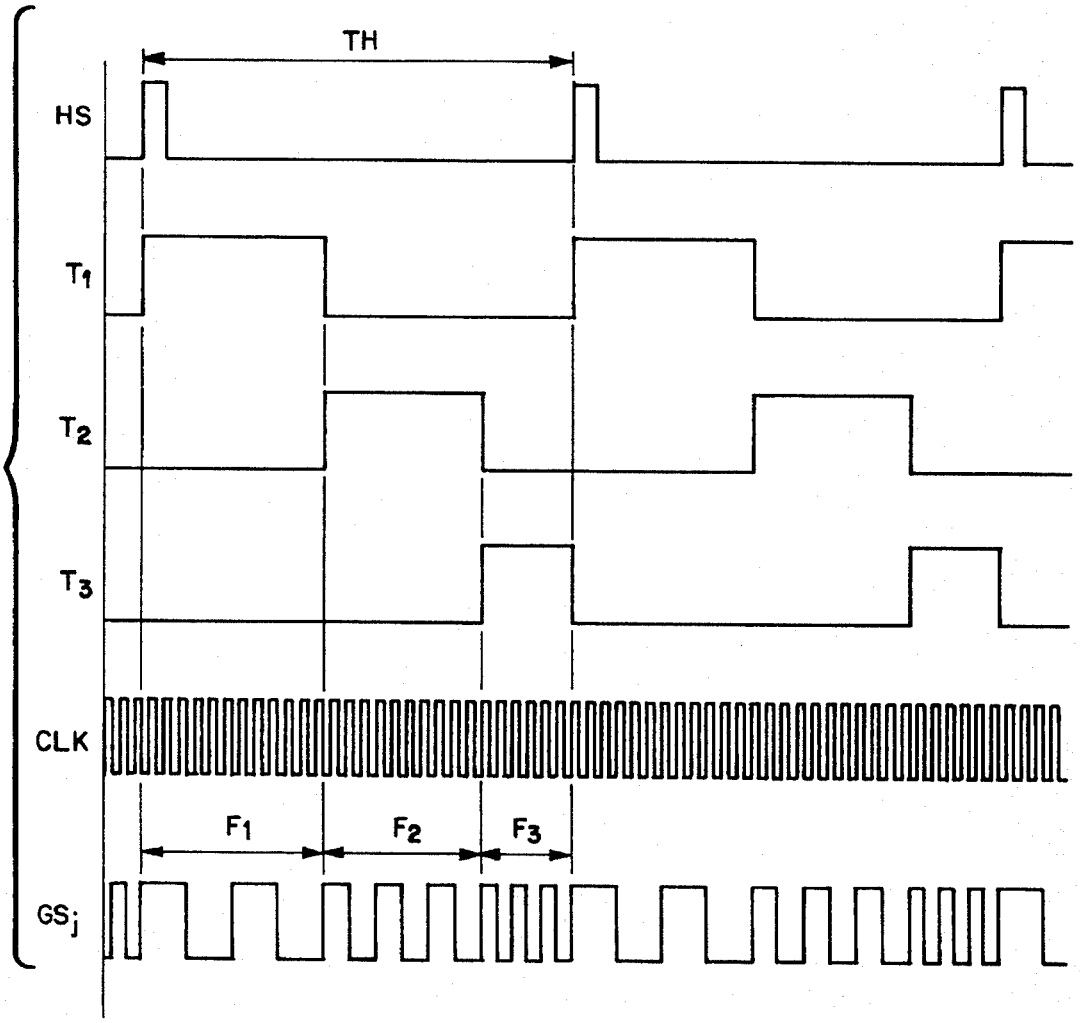
FIG. 7 is a timing diagram showing the operation of a clock period switching circuit used in the liquid crystal display apparatus of Example 2.

The operation of the liquid crystal display apparatus of this example will now be described referring to timing diagrams shown in FIGS. 7 through 9. FIG. 7 is a timing diagram for showing the operation of the clock period switching circuit 4, FIG. 8 is a timing diagram for showing the operation of the EXNOR circuit 3, and FIG. 9 is a timing diagram showing the voltage waveform at the pixel electrode P.

As is shown in FIG. 7, the term control signals T1, T2 and T3 are activated in a former portion, a middle portion and a latter portion of each horizontal scanning term TH, respectively. A term F1 when the term control signal T1 is at a high level is set to be the longest, and a term F3 when the term control signal T3 is at a high level is set to be the shortest. The clock period switching circuit 4 outputs to the pulse signal generating circuit 1 a clock signal CK having a period four times as long as that of the dot clock signal CLK in the term F1 when the term control signal T1 is at a high level. In a term F2 when the term control signal T2 is at a high level, the clock period switching circuit 4 outputs another clock signal CK having half the period, and in the term F3 when the term control signal T3 is at a high level, it outputs the dot clock signal CLK as a clock signal CK. Therefore, the pulse signal SPj generated by the pulse signal generating circuit 1 has the longest period in the first term F1 and the shortest period in the last term F3 in each horizontal scanning term TH.

Figure 8:
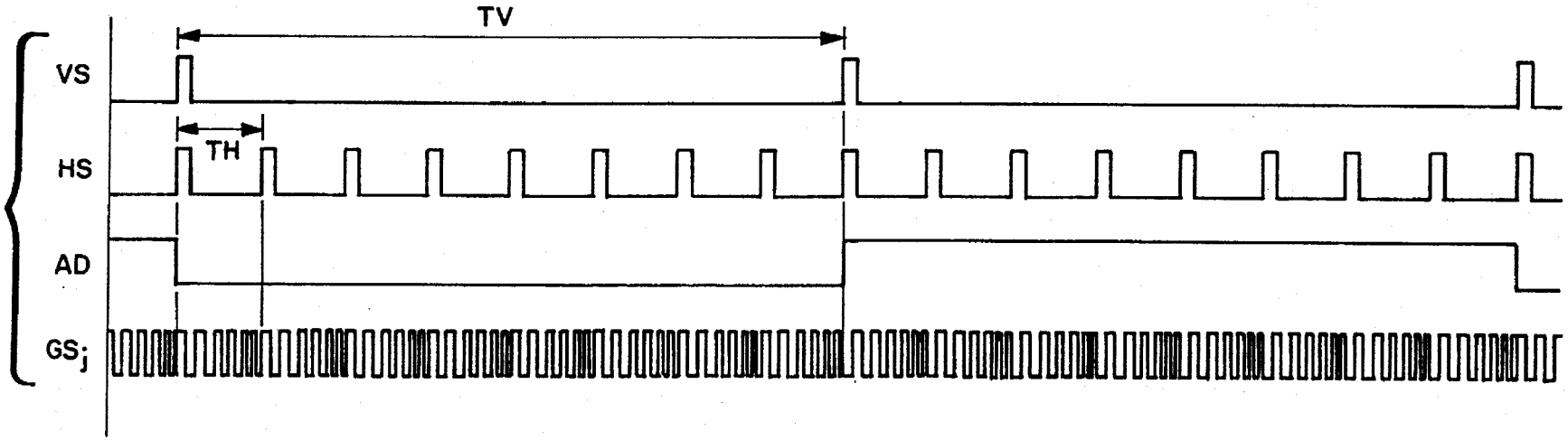
FIG. 8 is a timing diagram showing the operation of an EXNOR circuit used in the liquid crystal display apparatus of Example 2.

The pulse signal SPj is transferred to the EXNOR circuit 3 so as to calculate an exclusive OR with the AC driving signal AD, and then is output through the gray scale signal generating circuit 14 as the gray scale pulse signal GSj in which the duty ratio is inverted in each vertical scanning term TV as is shown in FIG. 8. Similarly to the column electrode driving circuit 16 of FIG. 27, the column electrode driving circuit 16 of this example also alternately repeats the two kinds of voltages VSH and VSL at the same period and at the same duty ratio as those of the gray scale pulse signal GSj, thereby outputting the column electrode driving signal OSi to the column electrode Si.

Figure 9:
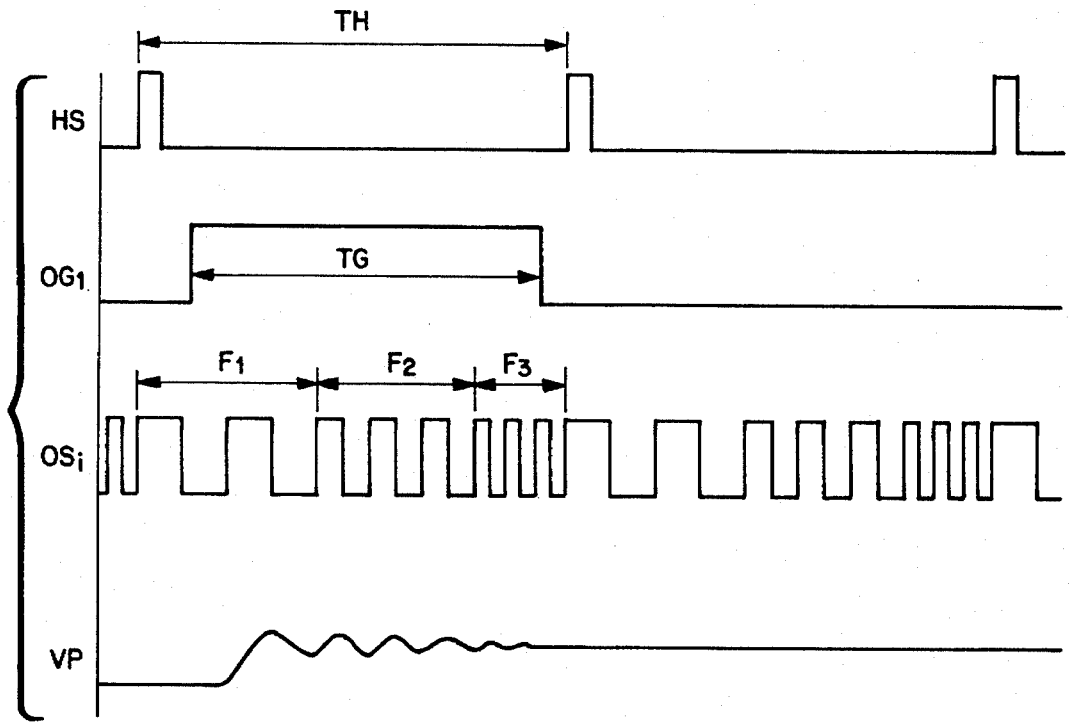
FIG. 9 is a timing diagram showing the voltage waveform at a pixel electrode in the liquid crystal display apparatus of Example 2.

Over the row electrode scanning term TG when, for example, the row electrode scanning signal OG1 is at a high level, the column electrode driving signal OSi is applied to a pixel electrode P1j as the oscillating voltage via a TFT Q1j as is shown in FIG. 9. Then, the voltage waveform VP of the pixel electrode P1j in consideration of the actual low-pass filter characteristic is not sufficiently averaged in the first term F1 since the period of the oscillating voltage is long. As time passes, however, through the term F2 to the term F3, the period of the oscillating voltage becomes successively shorter, and hence, the voltage waveform VP is sufficiently averaged and becomes substantially constant. At this point, in the case where the period of the oscillating voltage in the term F3 is set to be sufficiently short so as to attain a frequency in mHz, even when the periods in the previous terms F1 and F2 are rather long for sufficient averaging, the charging voltage can be averaged without fail in the last term F3 as far as the pixel electrode is charged to some extent. Further, as compared with the case where the oscillating voltage has a constant period that is short enough for the sufficient averaging over the entire row electrode scanning term TG, the number of the times of alternately repeating the voltages VSH and VSL in the row electrode driving signal OSi is sufficiently small in this example.

Figure 10:
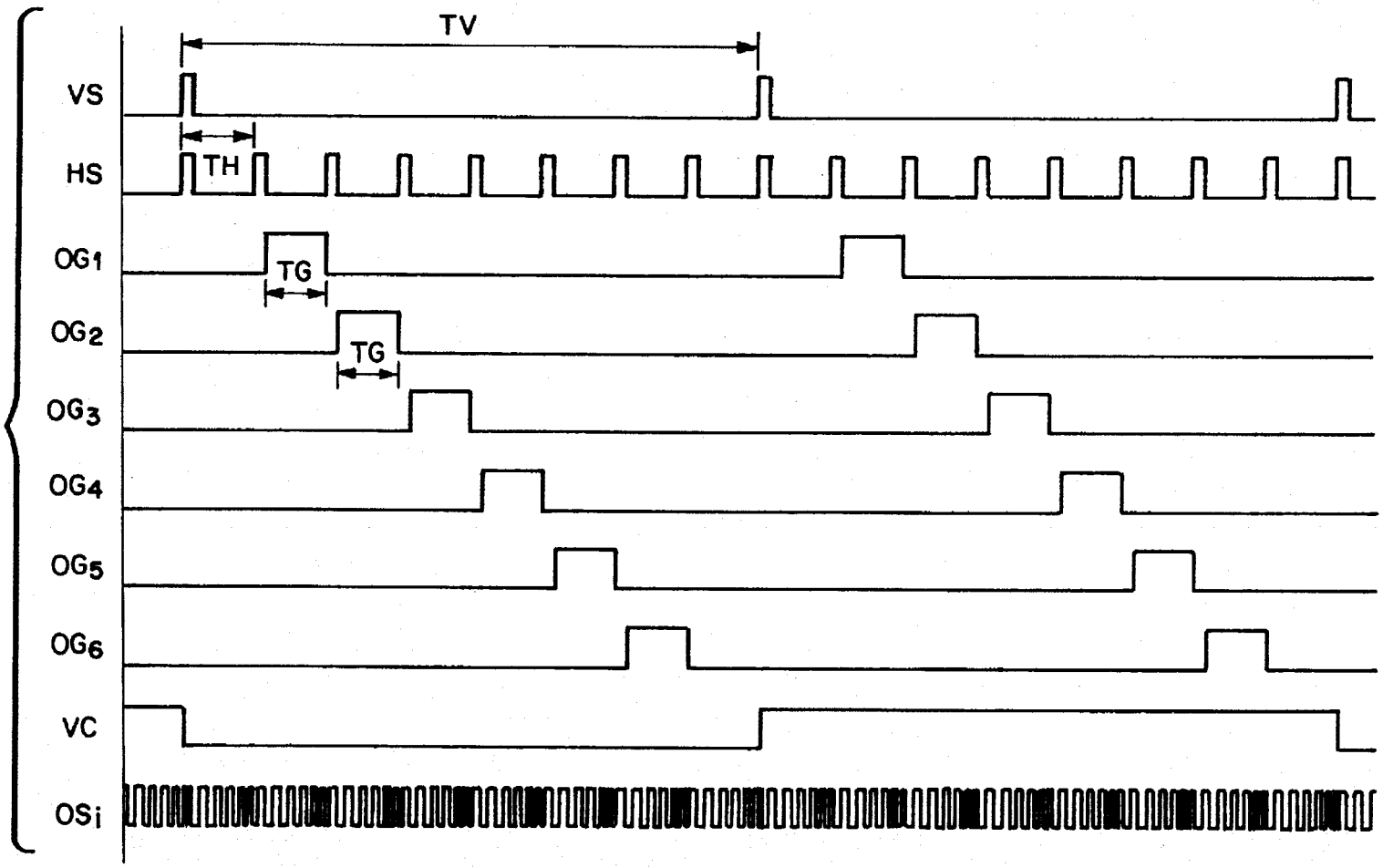
FIG. 10 is a timing diagram showing the operation of the liquid crystal display apparatus of Example 2.

Accordingly, in Example 2, although the two kinds of voltages VSH and VSL are alternately repeated in the column electrode driving signal OSi over the entire terms as is shown in FIG. 10, the number o times of charging/discharging the column electrode capacitance CS Of the column electrode Si is decreased in the former portion of each horizontal scanning term TH because the period of the oscillating voltage is long. As a result, the power consumed can be decreased. Further, in the latter portion of each horizontal scanning term TH, the charging voltage can be averaged without fail because the period of the oscillating voltage is sufficiently short. Therefore, there is no possibility of he degradation of the display quality.

EXAMPLE 3

An active matrix type liquid crystal display apparatus according to Example 3 will now be described. This liquid crystal display apparatus is also identical of those of Examples 1 and 2 except the configuration of a gray scale signal generating circuit 14, and hence the description of the common elements is omitted. The configuration of the gray scale signal generating circuit 14 is shown in a block diagram of FIG. 11.

Figure 11:
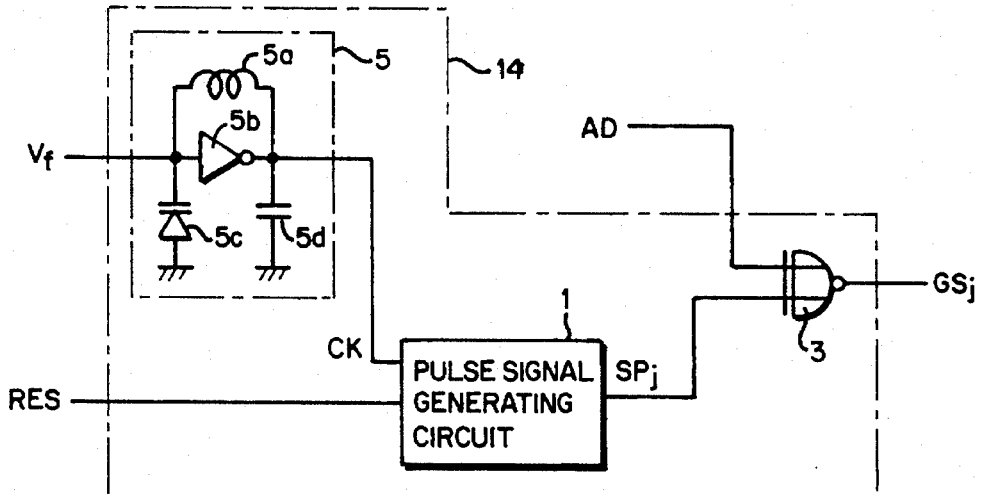
FIG. 11 is a block diagram showing the configuration of a gray scale signal generating circuit used in a liquid crystal display apparatus according to Example 3 of the invention.

The gray scale signal generating circuit 14 includes a clock period variable circuit 5 and plural sets of a pulse signal generating circuit 1 and an EXNOR circuit 3 as is shown in FIG. 11, and the number of the sets is equal to the number of levels of the gray scale display. Also FIG. 11 shows merely one set of the pulse signal generating circuit 1 and the EXNOR circuit 3. The clock period variable circuit 5 is a variable frequency oscillator including an inductance 5*a*, an inverter circuit 5*b*, a varicap (variable capacitor diode) 5*c* and a capacitor 5*d*. A frequency control voltage Vf transferred from a timing controller 13 is applied to the varicap 5*c* of the clock period variable circuit 5. Therefore, when the voltage level of the frequency control voltage Vf is varied, the capacitance of the varicap 5*c* is accordingly varied, resulting in varying the oscillation frequency of the clock period variable circuit 5. The oscillating signal from the clock period variable circuit 5 is supplied to the pulse generating circuit 1 as a clock signal CK.

Each pulse signal generating circuit 1 generates, in accordance with the clock signal CK supplied by the clock period variable circuit 5 and a reset signal RES generated by the timing controller 13, a pulse signal SPj having the same period as and a different duty ratio from those of signals generated by the other pulse signal generating circuits. The rest of the circuit configuration is the same as that of the conventional liquid crystal display apparatus shown in FIG. 26.

Figure 12:
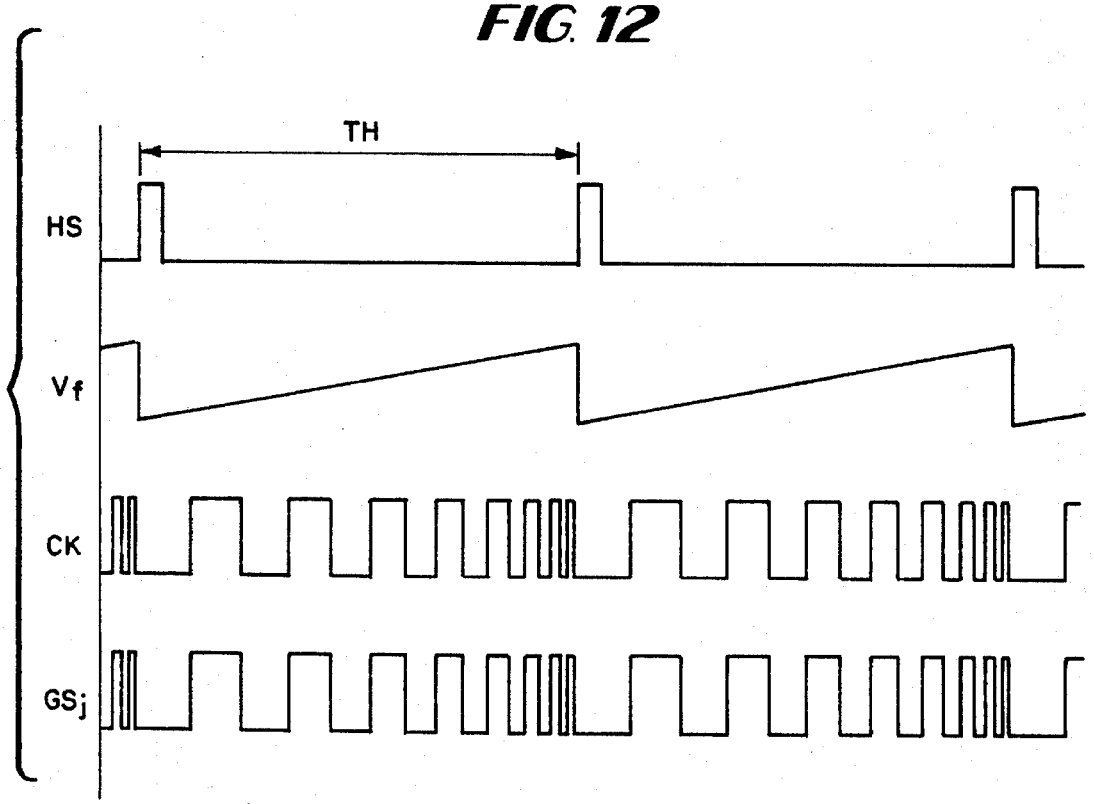
FIG. 12 is a timing diagram showing the operation of a clock period variable circuit used in the liquid crystal display apparatus of Example 3.

The operation of this liquid crystal display apparatus will be described referring to timing diagrams shown in FIGS. 12 through 14. FIG. 12 is a timing diagram for showing the operation of the clock period variable circuit 5, FIG. 13 is a timing diagram for showing the operation of the EXNOR circuit 3 and FIG. 14 is a timing diagram for showing the voltage waveform at a pixel electrode.

As is shown in FIG. 12, the frequency control voltage Vf is a sawtooth wave whose voltage level is linearly varied between a high level and a low level in each horizontal scanning term TH. When the frequency control voltage Vf is at a low level, the clock period variable circuit 5 generates an oscillating signal with a long period, and as the frequency control voltage Vf becomes higher, it generates an oscillating signal with a shorter period. Therefore, the pulse signal SPj generated by the pulse signal generating circuit 1 has a long period at the beginning of each horizontal scanning term TH. The period of the pulse signal SPj is steplessly shortened thereafter, and at the end of the horizontal scanning term TH, the period becomes short enough to attain a frequency in mHz.

Figure 13:
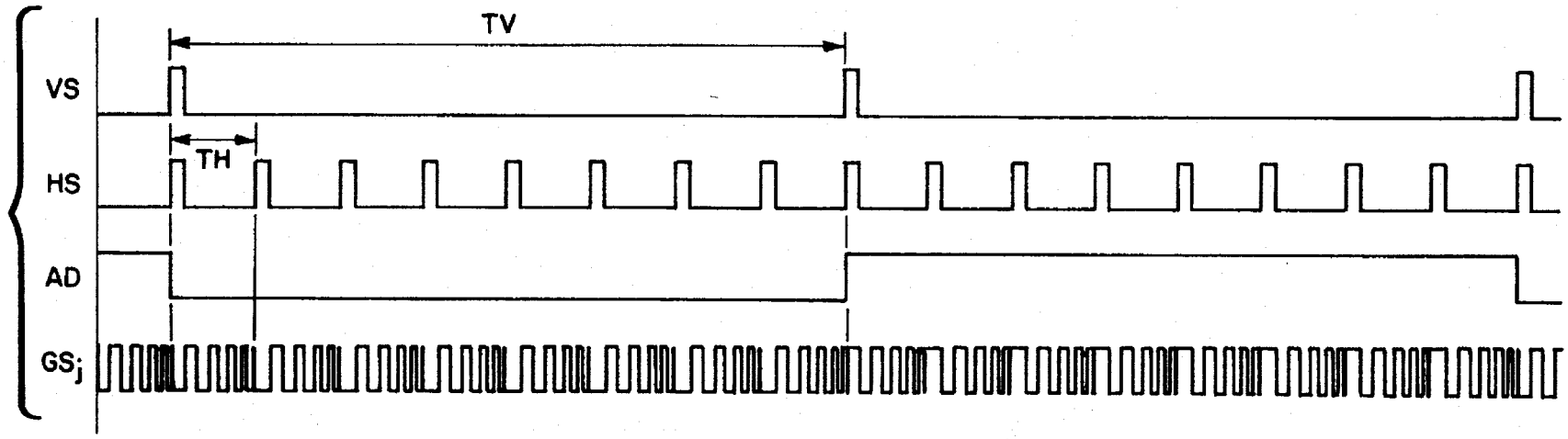
FIG. 13 is a timing diagram showing the operation of an EXNOR circuit used in the liquid crystal display apparatus of Example 3.
Figure 14:
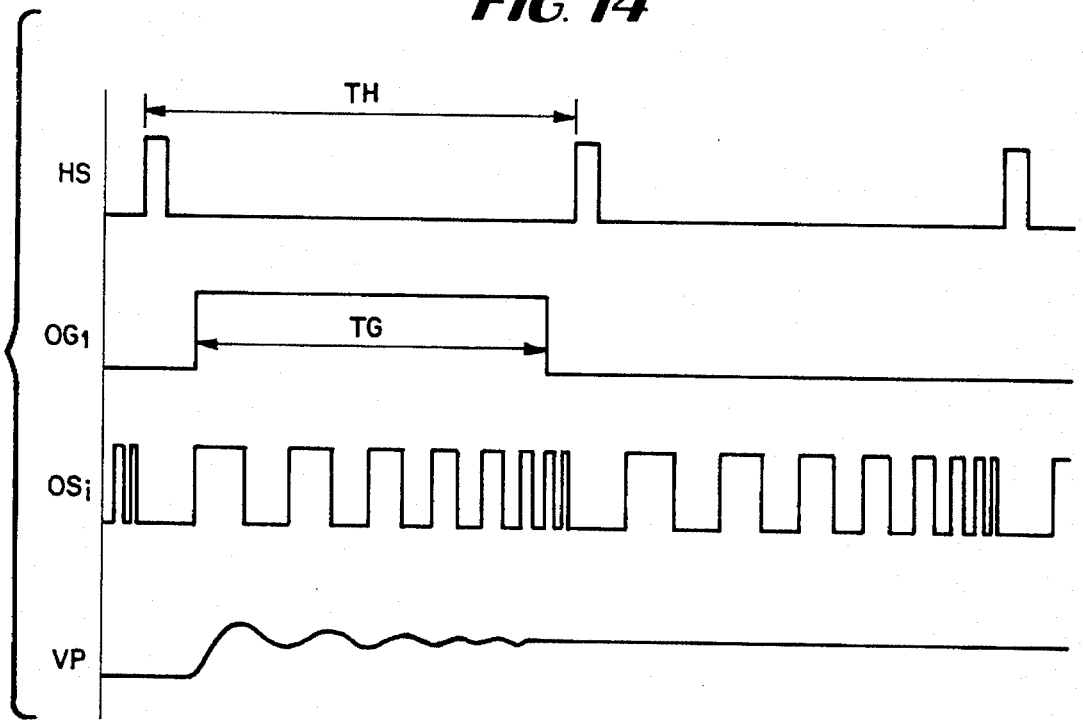
FIG. 14 is a timing diagram showing the voltage waveform at a pixel electrode in the liquid crystal display apparatus of Example 3.

The pulse signal SPj is transferred to the EXNOR circuit 3 so as to calculate an exclusive OR with the AC driving signal AD, and then is output through the gray scale signal generating circuit 14 as the gray scale pulse signal GSj in which the duty ratio is inverted in each vertical scanning term TV as is shown in FIG. 13. Similarly to the column electrode driving circuit 16 of FIG. 27, the column electrode driving circuit 16 of this example also alternately repeats the two kinds of voltages VSH and VSL at the same period and at the same duty ratio as those of the gray scale pulse signal GSj, thereby outputting the column electrode driving signal OSi to the column electrode Si.

Over the row electrode scanning term TG when, for example, a row electrode scanning signal OG1 is at a high level, the column electrode driving signal OSi is applied to a pixel electrode P1j as the oscillating voltage via a TFT Q1j as is shown in FIG. 9. Then, the voltage waveform VP of the pixel electrode P1j in consideration of the actual low-pass filter characteristic is not sufficiently averaged at first since the period of the oscillating voltage is long. As time passes, however, to the end of the row electrode scanning term TG, the period of the oscillating voltage is steplessly shortened, and hence, the voltage waveform VF is sufficiently averaged and becomes substantially constant. At this point, in the case where the period of the oscillating voltage at the end of the row electrode scanning term TG is set to be sufficiently short so as to attain a frequency in mHz, even when the previous periods are rather long for sufficient averaging, the charging voltage can be averaged without fail in the end as far as the pixel electrode is charged to some extent. Further, as compared with the case where the oscillating voltage has a constant period that is short enough for the sufficient averaging over the entire row electrode scanning term TG, the number of the times of alternately repeating the two kinds of voltages VSH and VSL in the row electrode driving signal 0i is sufficiently small in this example.

Accordingly, similarly to Example 2, also in Example 3, the number of the times of charging/discharging the column electrode capacitance CS of the column electrode Si is decreased in the former portion of each horizontal scanning term TH because the period of the oscillating voltage is long. As a result, the power consumed can be decreased. Further, in the latter portion of each horizontal scanning term TH, the charging voltage can be averaged without fail because the period of the oscillating voltage is sufficiently short. Therefore, there is no possibility of the degradation of the display quality. In addition, since the period of the oscillating voltage can be steplessly and smoothly shortened in this example, the charging voltage can be averaged more rapidly than in Example 2.

Figure 15:
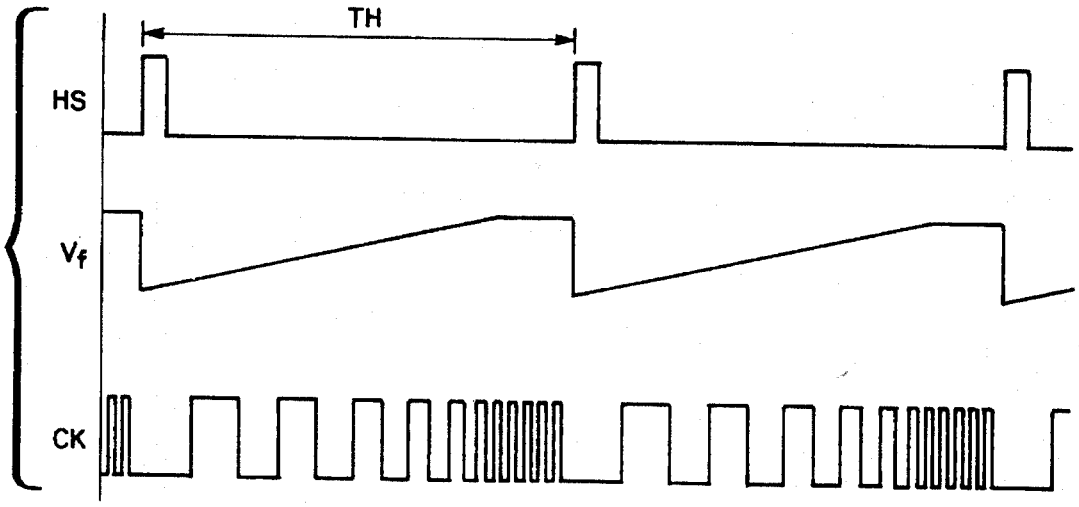
FIG. 15 is a timing diagram showing another operation of the clock period variable circuit used in the liquid crystal display apparatus of Example 3.

FIG. 15 is a timing diagram showing another operation of the clock period variable circuit 5. As is shown in FIG. 15, the frequency control voltage Vf is linearly increased to a high level in the former portion of each horizontal scanning term TH, and can be retained at the same constant level in the latter portion of the horizontal scanning term TH. In this case, the period of the pulse signal SPj generated by the pulse signal generating circuit 1 is steplessly shortened at the beginning of the horizontal scanning term TH, and becomes constant in the end. Thus, the application of an oscillating voltage having too short a period can be avoided at the very end of the horizontal scanning term TH.

EXAMPLE 4

Figure 16:
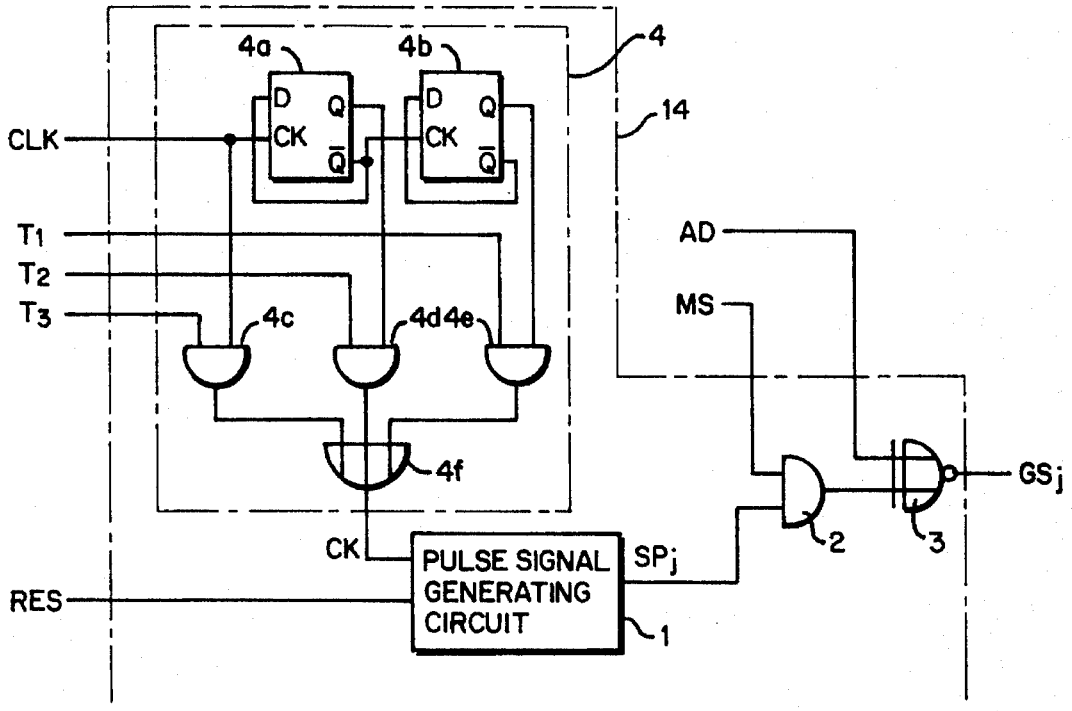
FIG. 16 is a block diagram showing the configuration of a gray scale signal generating circuit used in a liquid crystal display apparatus according to Example 4 of the invention.

Example 4 is a combination of Examples 1 and 2, and the configuration of a gray scale signal generating circuit 14 used in a liquid crystal display apparatus of Example 4 is shown in the block diagram of FIG. 16. The gray scale signal generating circuit 14 includes both an AND circuit 2 and a clock period switching circuit 4. As a result, in this liquid crystal display apparatus, no oscillating voltage is applied to a column electrode S in a non-drive term that makes no contribution to the charge of a pixel electrode P. In addition, in the former portion of each horizontal scanning term TH, the oscillating voltage has a longer period, so that the number of the times of charging/discharging a column electrode capacitance CS of a column electrode Si be decreased. Accordingly, the waste of power for the charge/discharge of the column electrode capacitance CS can be avoided.

EXAMPLE 5

Figure 17:
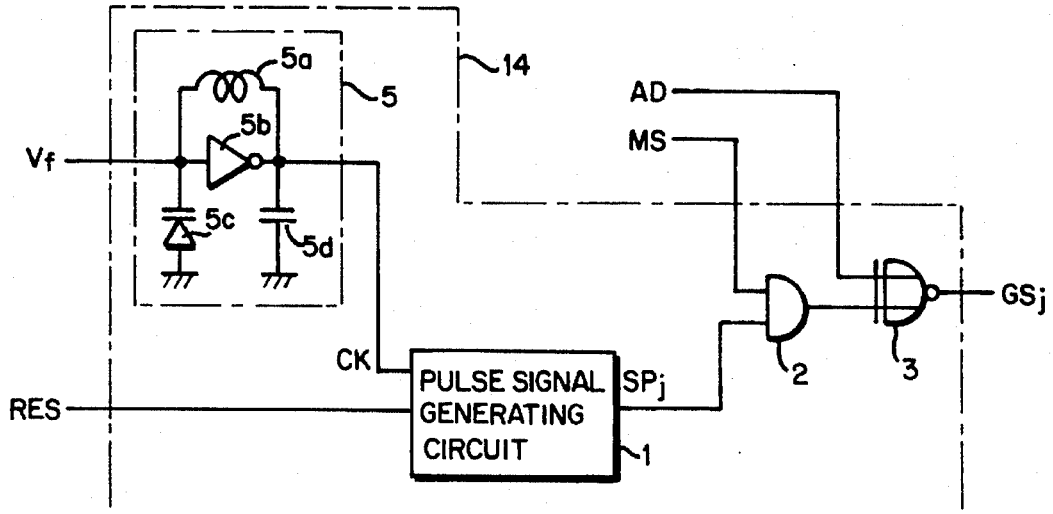
FIG. 17 is a block diagram showing the configuration of a gray scale signal generating circuit used in a liquid crystal display apparatus according Example 5 of the invention.
Figure 18:
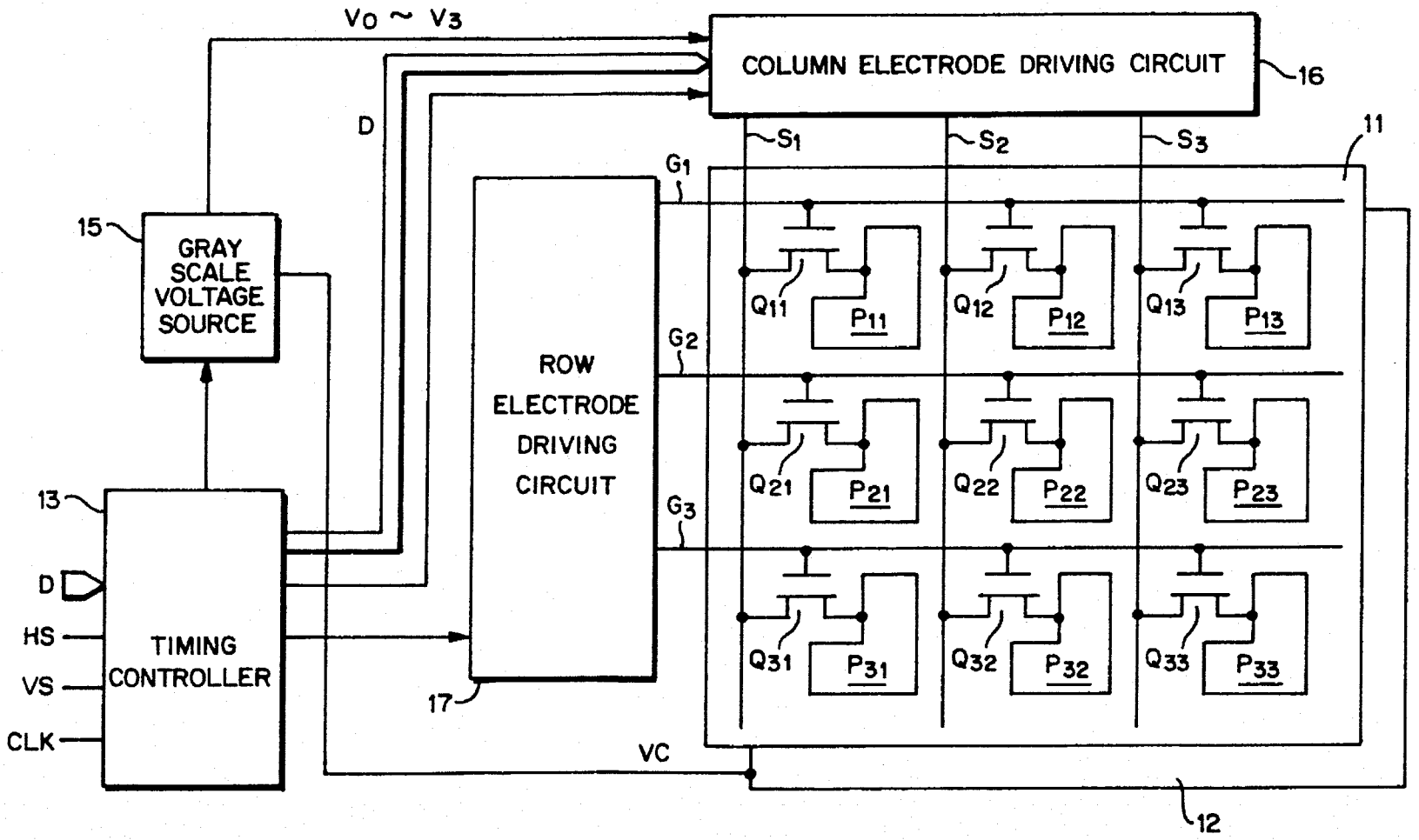
FIG. 18 is a block diagram showing the configuration of a first conventional liquid crystal display apparatus.
Figure 19:
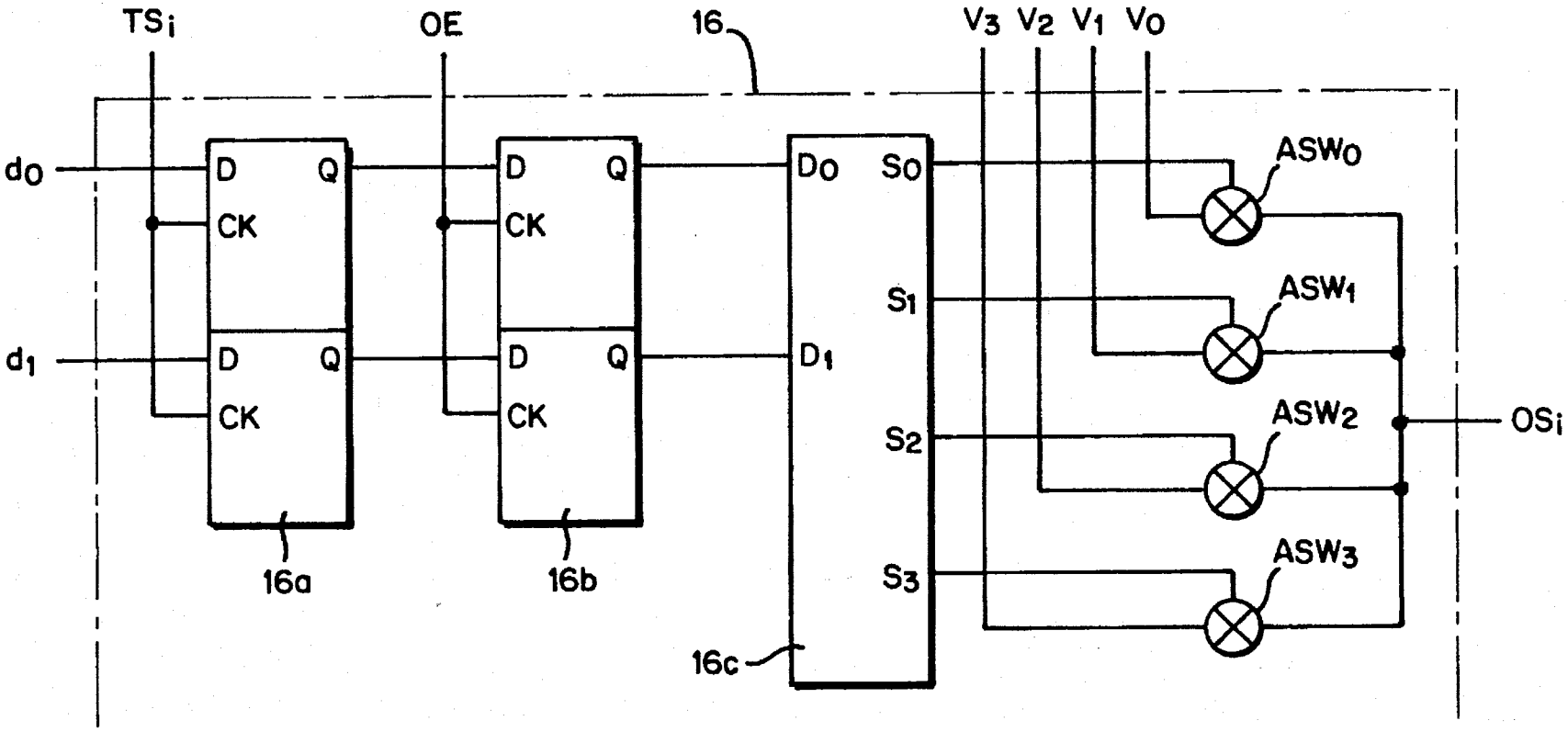
FIG. 19 is a block diagram showing the configuration of a column electrode driving circuit used in the liquid crystal display apparatus of FIG. 18.
Figure 20:
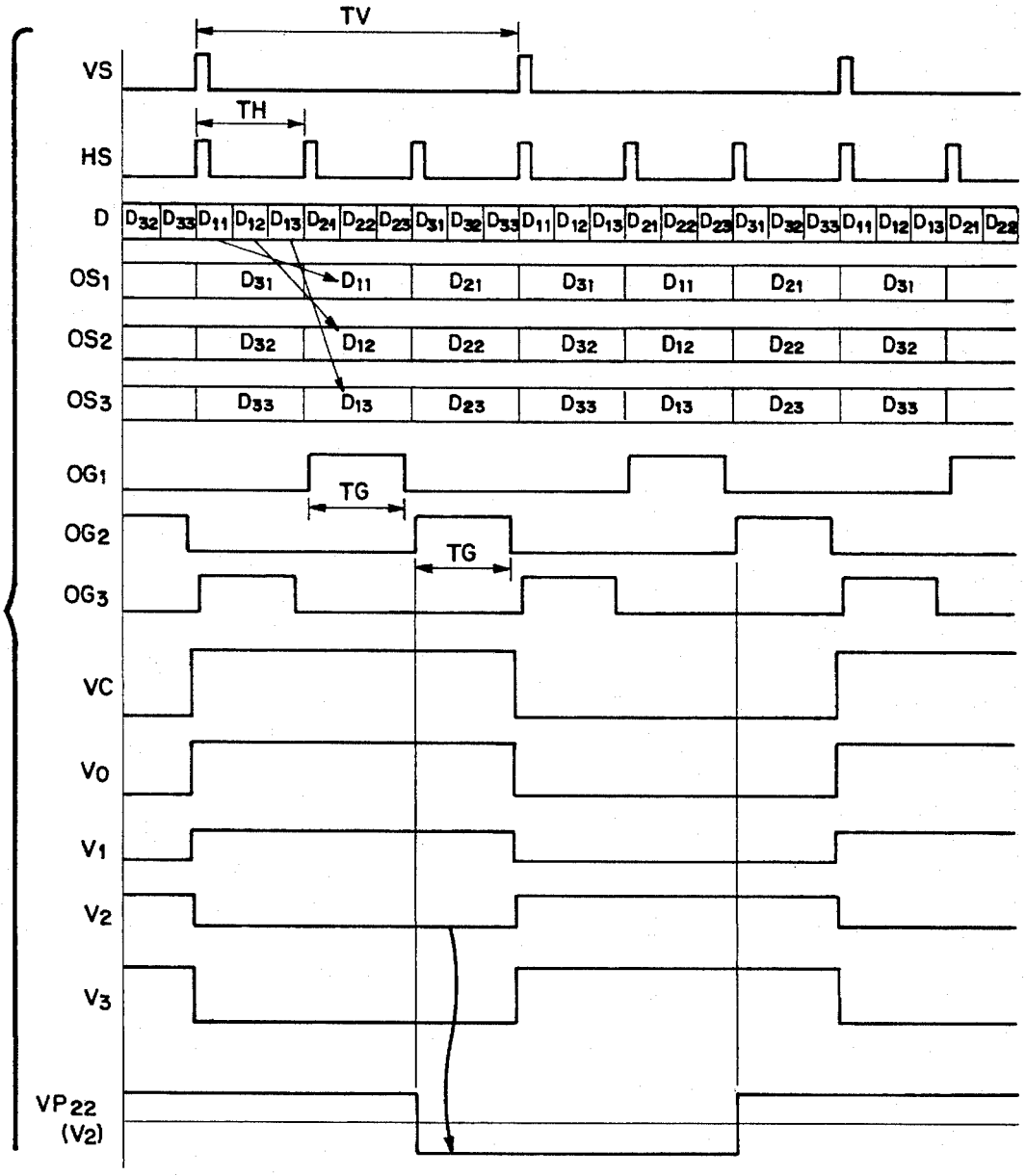
FIG. 20 is a timing diagram showing the operation of the liquid crystal display apparatus of FIG. 18.
Figure 21:
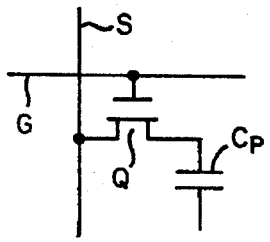
FIG. 21 is a diagram of an equivalent circuit of a pixel in the liquid crystal display apparatus of FIG. 18.
Figure 22:
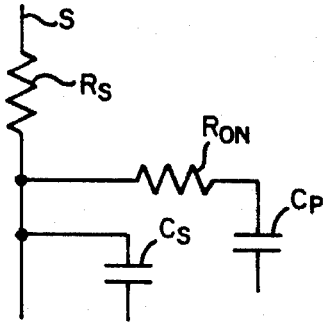
FIG. 22 is a diagram of an equivalent circuit around the pixel in the liquid crystal display apparatus of FIG. 18.
Figure 23:
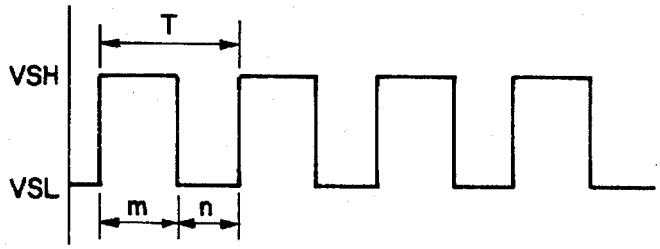
FIG. 23 is a timing diagram for pulse signals used in the liquid crystal display apparatus of FIG. 18.
Figure 24:
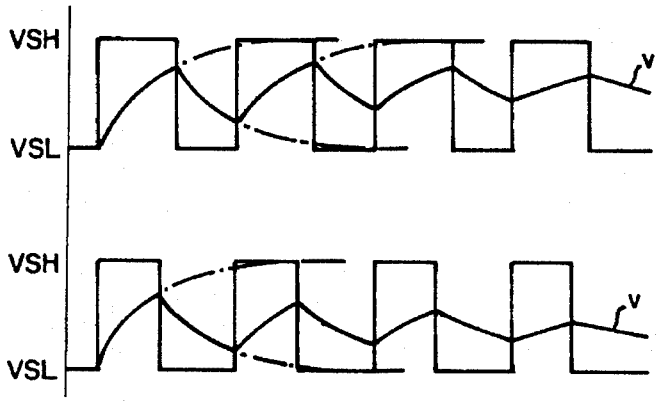
FIG. 24 is a timing diagram showing the averaging of pulse signals having different duty ratios in a charging/discharging circuit.

Example 5 is a combination of Examples 1 and 3, and the configuration of a gray scale signal generating circuit 14 used in a liquid crystal display apparatus of Example 5 is shown in a block diagram of FIG. 17. This gray scale signal generating circuit 14 includes both an AND circuit 2 and a clock period variable circuit 5. Therefore, also in this liquid crystal display apparatus, no oscillating voltage is applied to a column electrode S in a non-drive term that makes no contribution to the charge of a pixel electrode P. In addition, the oscillating voltage has a longer period at the beginning of each horizontal scanning term TH, so that the number of the times of charging/discharging a column electrode capacitance CS of a column electrode Si is decreased. As a result, the waste of power for the charge/discharge of the column electrode capacitance CS can be avoided.

Although a liquid crystal display apparatus is described in the aforementioned examples, the present invention is applicable to the other display apparatuses using the other electro-optical materials.

As is apparent from the above description, according to the present invention, power to be consumed in a display apparatus can be decreased by voltage switching inhibition means for avoiding wasteful charge/discharge of a column electrode capacitance in a non-drive term which makes no contribution to the charge of a pixel electrode. Furthermore, the power consumed in a display apparatus can be decreased by elongating the switching period for voltages at the beginning of a row electrode scanning term so as to decrease the number of times of wastefully charging/discharging the column electrode capacitance.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An active matrix type display apparatus comprising:

a display medium made of an electro-optical material;

a pair of substrates opposing each other with the display medium interposed therebetween;

a plurality of pixel electrodes formed in a matrix on one of the substrates;

a plurality of row electrodes each of which is disposed so as to correspond to each row of the pixel electrodes in the matrix;

a plurality of column electrodes each of which is disposed so as to correspond to each column of the pixel electrodes in the matrix;

switching devices each of which is disposed so as to correspond to each of the pixel electrodes, connects the corresponding pixel electrode to the column electrode corresponding to the pixel electrode, and is connected to the row electrode corresponding to the pixel electrode through a control terminal thereof;

a row electrode driving circuit for applying a voltage to each of the row electrodes so that the corresponding switching device becomes conductive only in a row electrode scanning term during a horizontal scanning term assigned to each of the row electrodes;

a column electrode driving circuit for alternately applying two kinds of voltages to each of the column electrodes repeatedly at a duty ratio in accordance with a display data corresponding to each of the column electrodes; and voltage switching inhibition means for inhibiting switching of the voltages to be applied to each of the column electrodes by the column electrode driving circuit at least in a part of a horizontal scanning term that is not assigned as the row electrode scanning term of any of the row electrodes.

2. An active matrix type display apparatus according to claim 1, wherein the column electrode driving circuit comprises:

pulse signal generating circuits for generating plural kinds of pulse signals having different duty ratios;

a pulse signal selecting circuit for selecting one of the pulse signals in accordance with the display data corresponding to each of the column electrodes; and a voltage switching circuit for switching a voltage to be applied to each of the column electrodes between the two kinds of voltages in accordance with the selected pulse signal, and the voltage switching inhibition means masks the plural pulse signals generated by the pulse signal generating circuits over substantially the entirety of a horizontal scanning term that is not assigned as the row electrode scanning term of any of the row electrodes, so that the pulse signals have a constant voltage level, and transfers the masked signals to the pulse signal selecting circuit.

3. A display apparatus according to claim 1, wherein the column electrode driving circuit varies a switching period for the voltages to be applied to each of the column electrodes in each horizontal scanning term, so that the switching period becomes shorter at the end of each row electrode scanning term than at least at the beginning of the row electrode scanning term, and the display apparatus further comprises voltage switching period shortening means for not increasing the switching period in the row electrode scanning term.

4. An active matrix type display apparatus according to claim 3, wherein the column electrode driving circuit comprises:

pulse signal generating circuits for generating plural pulse signals having different duty ratios;

a pulse signal selecting circuit for selecting one of the pulse signals in accordance with the display data corresponding to each of the column electrodes; and a voltage switching circuit for switching a voltage to be applied to each of the column electrodes between the two kinds of voltages in accordance with the selected pulse signals, and the voltage switching period shortening means varies a switching period for the voltages to be applied to the column electrodes in each horizontal scanning term, so that the switching period become shorter at the end of each row electrode scanning term than at least at the beginning of the row electrode scanning term, and does not increase the switching period in the row electrode scanning term.

5. An active matrix type display apparatus according to claim 1, wherein he electro-optical material is liquid crystal.

6. An active matrix type display apparatus comprising:

a display medium made of an electro-optical material;

a pair of substrates opposing each other with the display medium interposed therebetween;

a plurality of pixel electrodes formed in a matrix on one of the substrates;

a plurality of row electrodes each of which is disposed so as to correspond to each row of the pixel electrodes in the matrix;

a plurality of column electrodes each of which is disposed so as to correspond to each column of the pixel electrodes in the matrix;

switching devices each of which is disposed so as to correspond to each of the pixel electrodes, connects the corresponding pixel electrode to the column electrode corresponding to the pixel electrode, and is connected to the row electrode corresponding to the pixel electrode through a control terminal thereof;

a row electrode driving circuit for applying a voltage to each of the row electrodes so that the corresponding switching device become conductive only in a row electrode scanning term during a horizontal scanning term assigned to each of the row electrodes;

a column electrode driving circuit for alternately applying two kinds of voltages to each of the column electrodes repeatedly at a duty ratio in accordance with a display data corresponding to each of the column electrodes; and voltage switching period shortening means for varying a switching period for the voltages to be applied to each of the column electrodes in each horizontal scanning term, so that the switching period becomes shorter at the end of each row electrode scanning term than at least at the beginning of the row electrode scanning term, and for not increasing the switching period in the row electrode scanning term.

7. An active matrix type display apparatus according to claim 6, wherein the column electrode driving circuit comprises:

pulse signal generating circuits for generating plural pulse signals having different duty ratios;

a pulse signal selecting circuit for selecting one of the pulse signals in accordance with the display data corresponding to each of the column electrodes; and a voltage switching circuit for switching a voltage to be applied to each of the column electrodes between the two kinds of voltages in accordance with the selected pulse signal, and the voltage switching period shortening means varies a switching period for the voltages to be applied to the column electrodes in each horizontal scanning term, so that the switching period become shorter at the end of each row electrode scanning term than at least at the beginning of the row electrode scanning term, and does not increase the switching period in the row electrode scanning term.

8. An active matrix type display apparatus according to claim 6, wherein the voltage switching period shortening means shortens the switching period for the two kinds of voltages in a stepwise manner in each row electrode scanning term.

9. An active matrix type display apparatus according to claim 6, wherein the voltage switching period shortening means steplessly shortens the switching period for the two kinds of voltages in each row electrode scanning term.

10. An active matrix type display apparatus according to claim 6, wherein the voltage switching period shortening means steplessly shortens the switching period for the two kinds of voltages up to an intermediate point in each row electrode scanning term and makes the switching period constant thereafter.

11. An active matrix display apparatus according to claim 6, wherein the electro-optical material is liquid crystal.

* * * * *